US005529111A

United States Patent [19]

Freeman

[11] Patent Number: 5,529,111

[45] Date of Patent: Jun. 25, 1996

[54] BULK LUBRICANT DELIVERY UNIT FOR A DIE CASTER

[76] Inventor: Lewis G. Freeman, 1509 Pontiac Dr., Kokomo, Ind. 46902

[21] Appl. No.: 534,128

[22] Filed: Sep. 26, 1995

[51] Int. Cl.[6] ..... B22D 17/10; B22D 17/20

[52] U.S. Cl. ..... 164/149; 164/267; 164/312

[58] Field of Search ..... 164/149, 267, 164/312, 72, 113

[56] References Cited

U.S. PATENT DOCUMENTS

| | | | |
|---|---|---|---|
| 3,645,319 | 2/1972 | Pondelicek et al. | 164/267 X |
| 3,920,099 | 11/1975 | Pondelicek et al. . | |
| 4,605,170 | 8/1986 | Thurner | 164/149 X |
| 4,782,885 | 11/1988 | Evans . | |
| 5,039,435 | 8/1991 | Hanano . | |
| 5,052,466 | 10/1991 | Hanano | 164/267 |
| 5,076,343 | 12/1991 | Sandercock . | |
| 5,101,882 | 4/1992 | Freeman . | |
| 5,385,196 | 1/1995 | Hanano . | |
| 5,388,631 | 2/1995 | Suganuma et al. . | |

FOREIGN PATENT DOCUMENTS

| | | | |
|---|---|---|---|
| 627915 | 10/1978 | U.S.S.R. | 164/72 |

*Primary Examiner*—J. Reed Batten, Jr.
*Attorney, Agent, or Firm*—C. J. Fildes & Co.

[57] ABSTRACT

The delivery unit includes a transfer member in the form of two aligned plungers that act to transfer controlled amounts of lubricant from a loading chamber to a delivery chamber for delivery by air pressure to the casting apparatus. The volume of lubricant transferred is controlled by a charge control mechanism interconnecting the plungers for adjusting the distance between the plunger ends.

16 Claims, 17 Drawing Sheets

BULK LUBRICANT DELIVERY UNIT FOR A DIE CASTER

FIELD OF THE INVENTION

This invention relates to die casting apparatus and, in particular, to such apparatus in combination with a bulk lubricant delivery unit for delivery of bulk lubricant into the die cavity, shot sleeve, and related internal surfaces of the apparatus. The invention includes various embodiments of bulk lubricant delivery units for use in delivering dry, liquid, or mixed bulk lubricants to air associated die casting apparatus.

BACKGROUND OF THE INVENTION

For many years, the primary method of applying lubricants or die release agents to the surfaces of a die casting die has been through spraying of a liquid carried lubricant onto the die cavity surfaces when the die pair is open. More recently, several forms of lubricating mechanisms or apparatus for use in conjunction with die casting apparatus have been proposed but it is not believed that they have met with wide-spread acceptance.

SUMMARY OF THE INVENTION

The present invention provides various related embodiments of bulk lubricant delivery units having related features for use with and in combination with die casting die apparatus. In addition to variations of the several embodiments, the invention further includes alternative arrangements for connecting the lubricant delivery units to a die casting die and associated apparatus.

In a particular embodiment, a bulk lubricant delivery unit according to the invention is characterized by:

a body having an inlet for receiving a charge of bulk lubricant from a supply source;

a transfer member within said body and movable between loading and delivery positions;

a delivery chamber defined between said body and said transfer member in said delivery position;

said transfer member having a transfer space communicating with said inlet in said loading position and with at least part of said delivery chamber in one of said loading and delivery positions; and charge control means for varying the volume of lubricant charge transferred from said transfer space in said loading position to said delivery chamber in said delivery position.

In addition, a die casting apparatus according to the invention may include a die casting machine having a die pair defining a cavity generally formed in both dies and separated by a parting line between the die pair, said die pair including a cover die and an ejector die with an inlet passage defined between said dies at the parting line and connecting said cavity with an exterior location;

said apparatus characterized by a bulk lubricant delivery unit for delivery of bulk lubricant to said die cavity, said delivery unit including a body having an inlet for receiving a charge of bulk lubricant front a supply source, a transfer member within said body and movable between loading and delivery positions, a delivery chamber defined between said body and said transfer member in said delivery position, said transfer member having a transfer space communicating with said inlet in said loading position and with at least part of said delivery chamber in one of said loading and delivery positions, charge control means for varying the volume of lubricant charge transferred from said transfer space in said loading position to said delivery chamber in said delivery position; and a delivery passage connecting said delivery chamber with said inlet passage of the die pair for delivery of controlled charges of bulk lubricant from the delivery chamber into said die cavity.

These and other features and advantages of the invention will be more fully understood from the following description of certain exemplary embodiments of the invention taken together with the accompanying drawings.

DETAILED DESCRIPTION OF THE INVENTION

Figure 1:
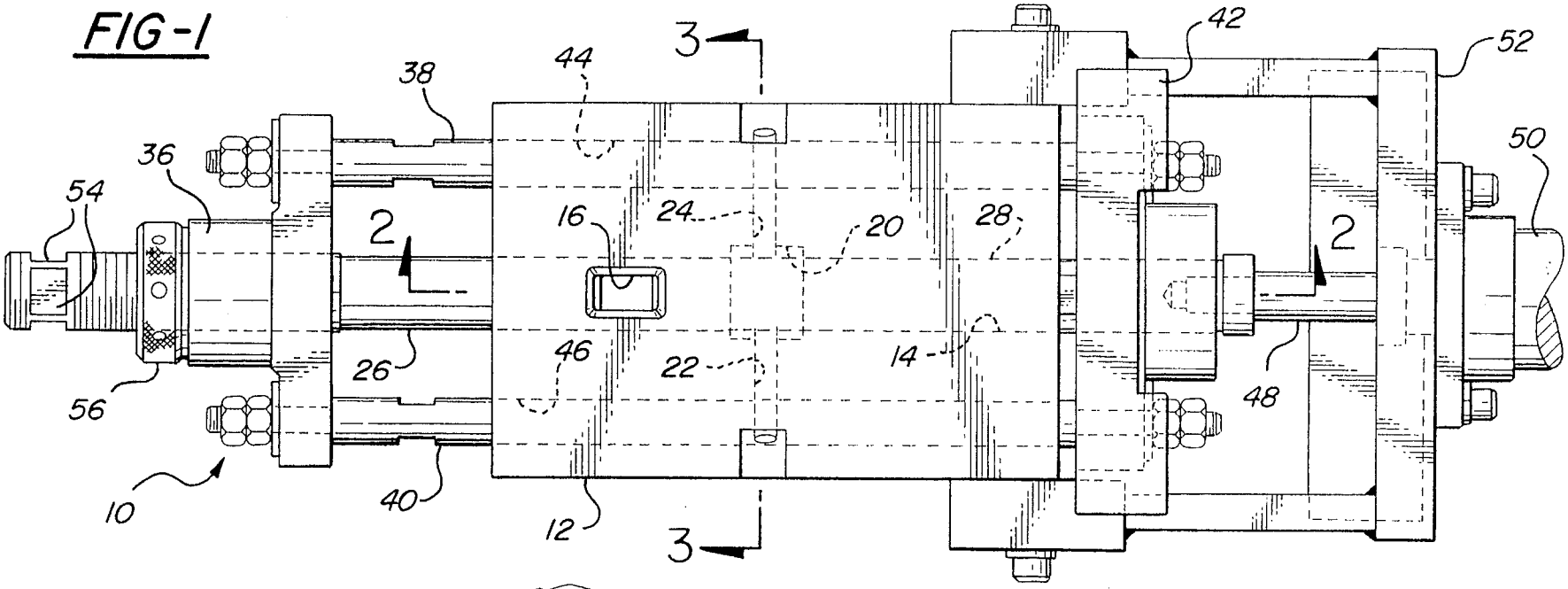
FIG. 1 is a plan view of a first embodiment of bulk lubricant delivery unit in accordance with the invention beginning a first group of four related embodiments.
Figure 2:
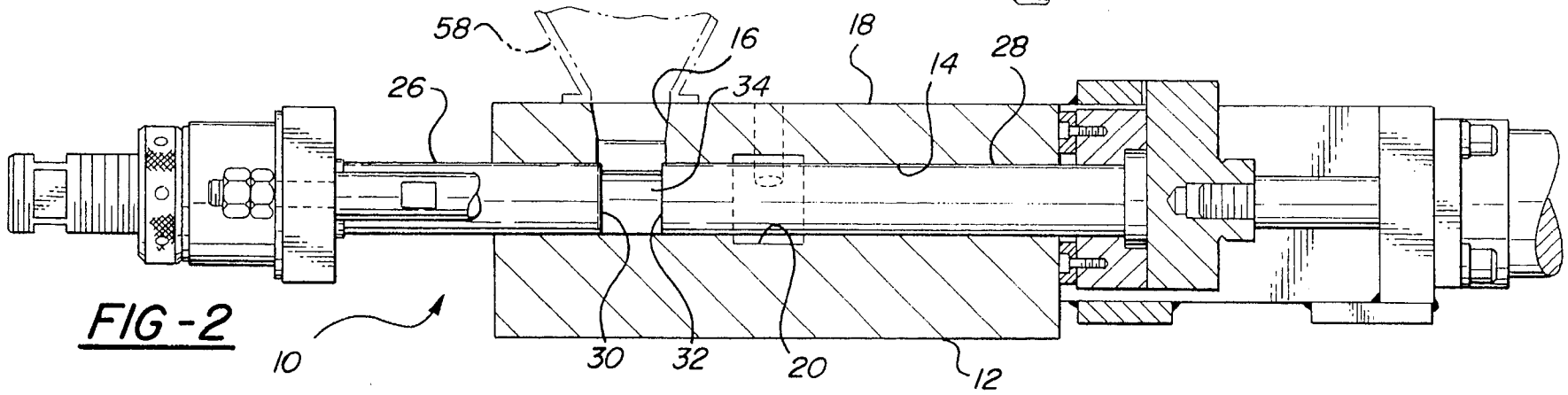
FIGS. 2 and 3 are side and transverse cross-sectional views taken in the planes indicated by the lines 2—2 and 3—3 of FIG. 1.
Figure 3:
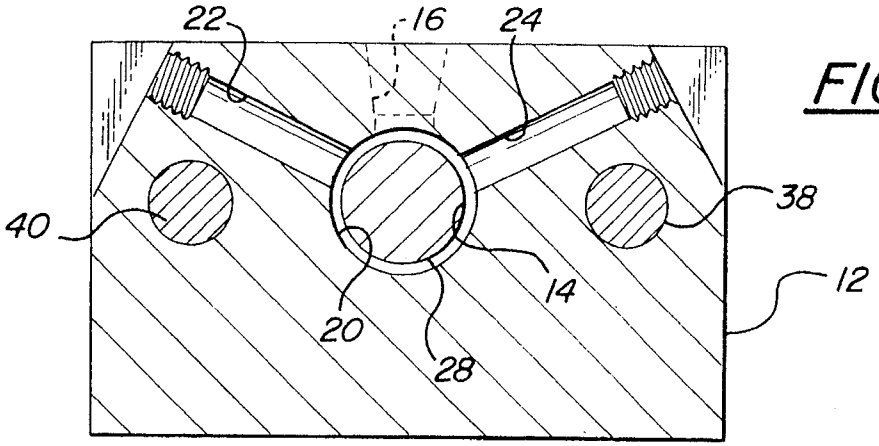

Referring now to the drawings in detail, FIGS. 1–3 illustrate a first embodiment of bulk lubricant delivery unit according to the invention and generally indicated by numeral 10. This is the first of four embodiments grouped together by similarity of certain structural characteristics. Unit 10 includes a generally rectangular body 12 having a longitudinal cylindrical bore 14 extending therethrough. Toward one end, the bore 14 connects with an inlet 16 having a generally rectangular shape with sides angled outwardly opening through the top 18 of the body 12. Spaced from the opening 16 toward the center of the body, a relief 20 defines an enlargement in the bore 14 which connects on one side with an upwardly angled gas inlet passage 22 and on the other side with an upwardly angled gas and lubricant delivery passage 24.

Within the bore 14, there is reciprocably disposed a transfer member or slide formed in part by a pair of cylindrical plungers 26, 28 having opposed spaced ends 30, 32, respectively. Ends 30, 32 together with the bore 14 define a variable volume chamber 34. When chamber 34 is in alignment with the inlet 16, as shown in FIGS. 1–3, chamber 34 comprises a loading changer.

Plunger members 26, 28 are interconnected by transfer elements including an adjusting head 36, guide rods 38, 40 and a transfer head 42. The transfer head 42 directly connects with plunger 28 and with the guide rods 38, 40 and these in turn connect with the adjusting head 36 which is connected to plunger 26. The guide rods are reciprocable in bores 44, 46, extending through the body 12, parallel with the bore 14. The transfer head 42 also connects with a rod 48 of an actuating cylinder 50 which is supported on a straddle mount 52 fixed to the body 12. The cylinder rod 48 drives the straddle mount 42 which directly drives plunger 28 and, through the guide rods 38, 40 and adjusting head 36, also drives the plunger 26.

Plunger 26 is threadably connected with the adjusting head 36 so that it can be longitudinally adjusted by turning the plunger with flats 54 near its outer end. A knurled lock ring 56 threaded on the plunger 26 is tightened against the adjusting head to lock the plunger 26 in its adjusted position. Longitudinal adjustment of the rod 26 relative to the adjusting head 36 moves the end 30 of rod 26 closer to or further from the opposed end 32 of plunger 28. The adjustment thus varies the volume of the loading chamber 34 which determines the volume of lubricant constituting a charge in this embodiment of the present invention.

Operation of the lubricant delivery unit 10 requires suitable means for supplying lubricant to the inlet 16. In this instance, the supply means is represented by a lubricant container 58, shown in phantom only in FIG. 2, mounted on the top 18 of the body 12. Operation further requires connection of the gas inlet passage 22 with a source of compressed air and connection of the delivery passage 24 with a suitable location on a mechanism such as an associated die casting machine to be described in detail subsequently.

In operation of a bulk lubricant delivery unit 10 as described, the charge to be delivered each stroke is first established by adjusting the position of the end 30 of plunger 26 relative to end 32 of plunger 28 to set a desired volume of the space comprising the loading chamber 34 for receiving lubricant in the loading position. This adjustment is accomplished by turning plunger 26 with the flats 54 to adjust its position by the screw threads within the adjusting head 36 and then locking the position with the lock ring 56.

The lubricant container is then filled with the lubricant to be delivered. This is preferably a powdered or granulated dry lubricant for use with the delivery unit as described. However, a liquid lubricant or a composite dry/liquid lubricant mixture could be used by modifying the delivery unit with seals in order to prevent leakage of the liquid as will be subsequently more fully discussed.

When the transfer slide is in the loading position shown in the figures, lubricant from the container 58 is fed by gravity through inlet 16 to the loading chamber 34, filling the space with the desired volume of lubricant. Cylinder 50 is then actuated to move the slide to a delivery position wherein the chamber 34 is moved to the location of the relief 20 in communication with the inlet passage 22 and delivery passage 24. At this point, some of the lubricant charge drops into the lower portions of the relief 20 which is provided to ensure a path for air flow within the space 34 that now defines in part a delivery chamber. Thereafter, a charge of compressed air is applied to the inlet passage 22 and picks up the powdered or granulated (or liquid) lubricant in the delivery chamber 34, carrying it with the air out of chamber 34, through the delivery passage 24, and by passage means not shown, to the die or other device to be lubricated.

Figure 4:
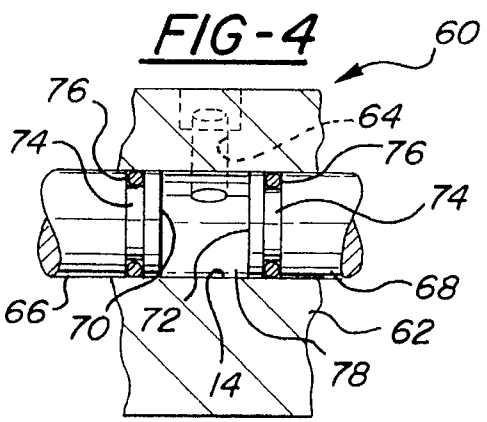
FIG. 4 is a fragmentary cross-sectional view similar to FIG. 2 but showing the plungers of the transfer slide in the delivery position and illustrating modifications for delivering liquid or liquid composite lubricant from the delivery unit.

FIG. 4 illustrates a modified delivery unit 60 which is basically the same as the embodiment of FIGS. 1–3 except that it includes changes which are exemplary of those that may be needed to convert the dry lubricant delivery unit of FIGS. 1–3 to deliver liquid lubricant or liquid composite lubricant having a combination of dry and liquid constituents. Unit 60 includes a body 62 from which the relief 20 of the prior embodiment has been omitted so that the bore 14 is continuous. Therefore, the delivery passage 64 and the inlet passage, not shown, connect directly with the bore 14 instead of with the relief. As before, the transfer slide includes separate plungers 66, 68, respectively, having opposed ends 70, 72, respectively, which may be varied in spacing to vary the lubricant charge. The plungers are provided with grooves 74 near their ends. O-ring seals 76 located in the grooves limit the leakage of liquid lubricant from the chamber 78 between the ends of the plungers. If necessary, the embodiment of FIGS. 1–3 could be provided with different forms of seals and additional seals in the body or the plunger as required to prevent leakage of the liquid or liquid composite lubricant to be delivered from the modified assembly.

Figure 5:
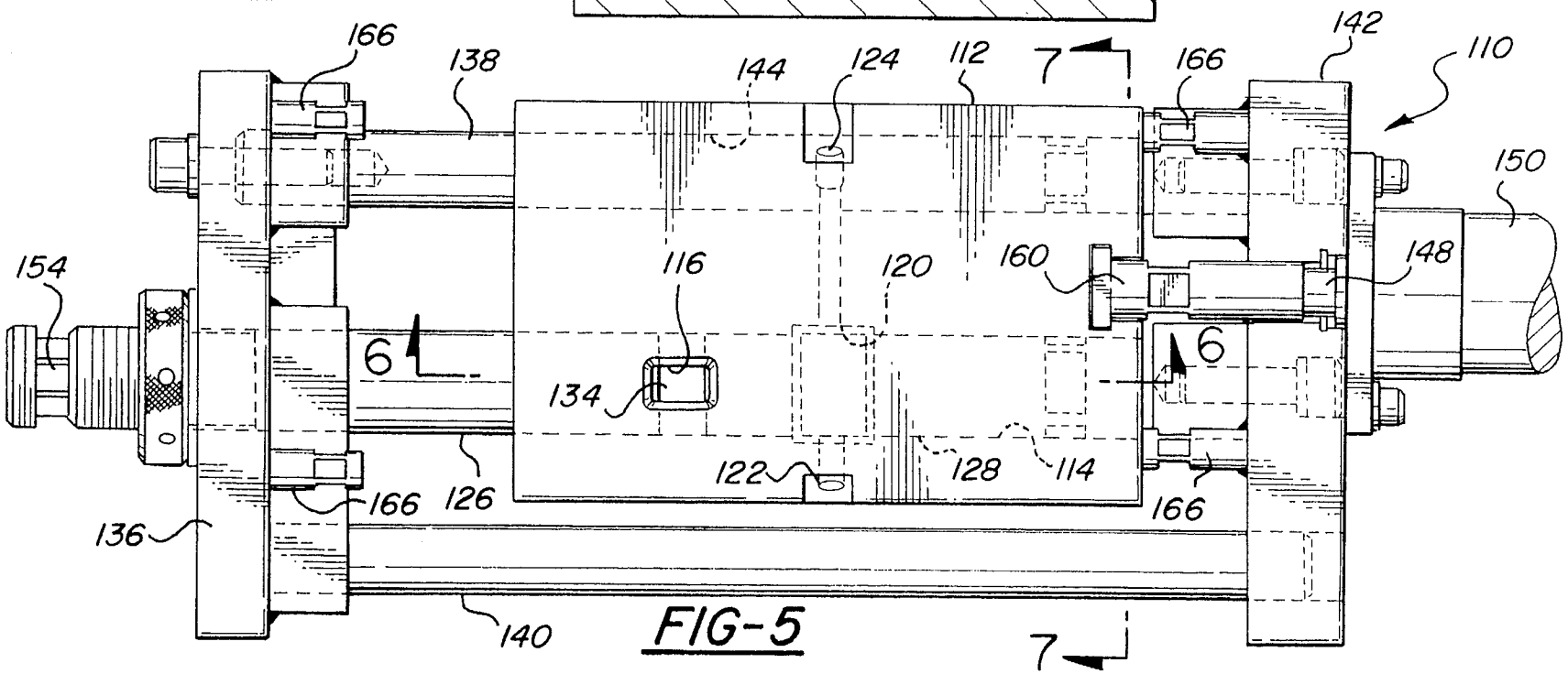
FIG. 5 is a plan view of a second embodiment of bulk lubricant delivery unit in accordance with the invention.
Figure 6:
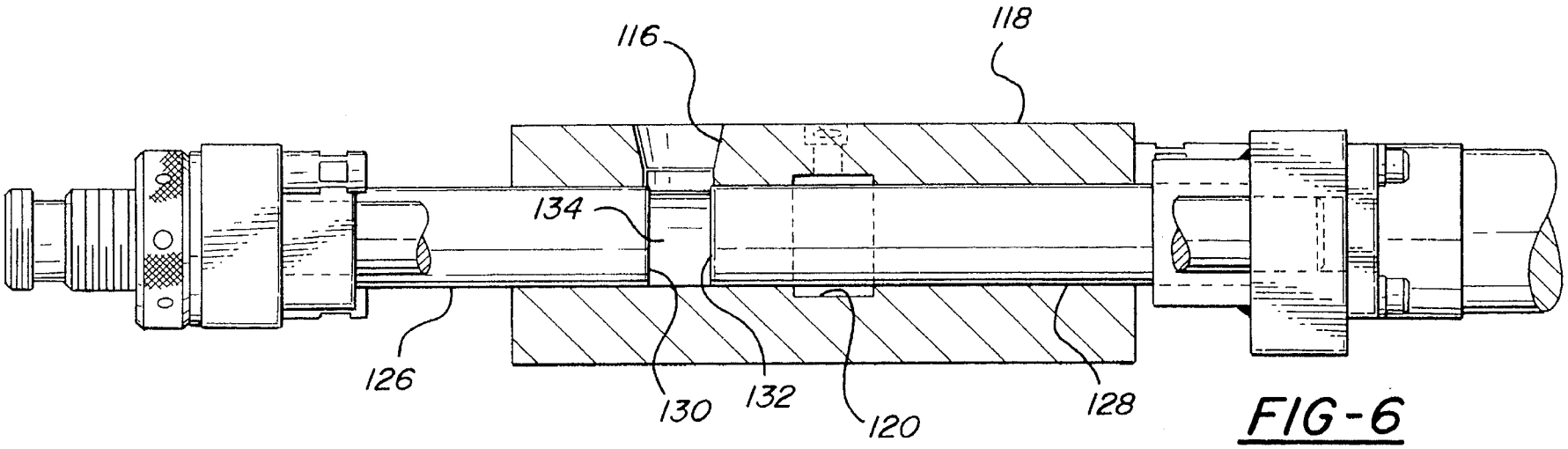
FIGS. 6 and 7 are side and transverse cross-sectional views from the planes of lines 6—6 and 7—7, respectively, of FIG. 5.
Figure 7:
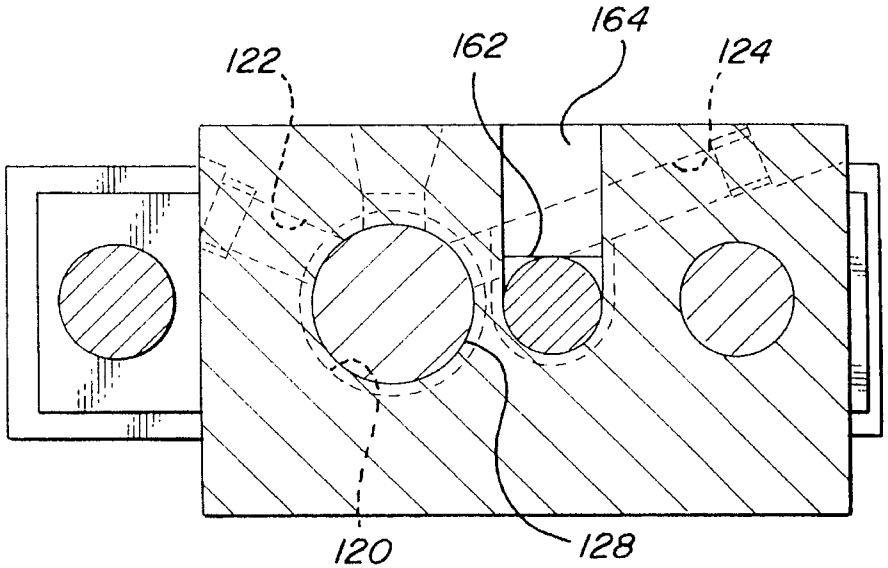

Referring next to FIGS. 5–7 of the drawings, there is shown a second embodiment of bulk lubricant delivery unit according to the invention and generally indicated by numeral 110. Unit 110 is the same as or similar in many respects to delivery unit 10 previously described so that 100 series numbers with similar suffix characters are used for similar components.

Thus unit 110 includes a body 112 having a bore 114 and an inlet 116 connecting with the bore and opening through the top 118 of the body. In the dry lubricant version shown, a relief 120 surrounds the bore 114 at the discharge location. The relief connects with a gas inlet passage 122 and a gas/lubricant delivery passage 124.

A slide member is provided as before made up of plungers 126 and 128 reciprocably slidable in the bore 114 and having opposed ends 130, 132, respectively, defining a chamber 134. Plunger 126 connects with an adjusting head 136 which in turn connects through guide rods 138, 140 with a transfer head 142. Guide rod 138 extends through a bore 144 in the body 112 but the guide rod 140 differs in that it is located beyond the outer edge of the body so that it does not extend through a bore.

This second embodiment of FIGS. 5–7 differs primarily in that cylinder 150 is mounted directly upon the transfer head 142 which connects through guide rods 138, 140 with the adjusting head 136, these heads being in turn connected with the slide plungers 126, 128. On the other hand, the cylinder rod 148 drives a connector 160 which has a head 162 engageable with a slot 164 in the body 112 so as to transfer longitudinal force in both directions. Stops 166 are provided on the heads 136, 142 to engage the body and limit travel of the slide relative to the body 112.

The operation of this second embodiment of FIGS. 5–7 is similar in function and result to that of the first embodiment except that the plunger rod 148 drives the block relative to the slide in order to move the chamber 134 from the loading position to the delivery position and return. Obviously, the unit may be mounted so that the block remains stationary and the cylinder 150 and transfer head 142 move or vice versa. In any event, the internal operation of the unit is the same as that of the first described embodiment.

Figure 8:
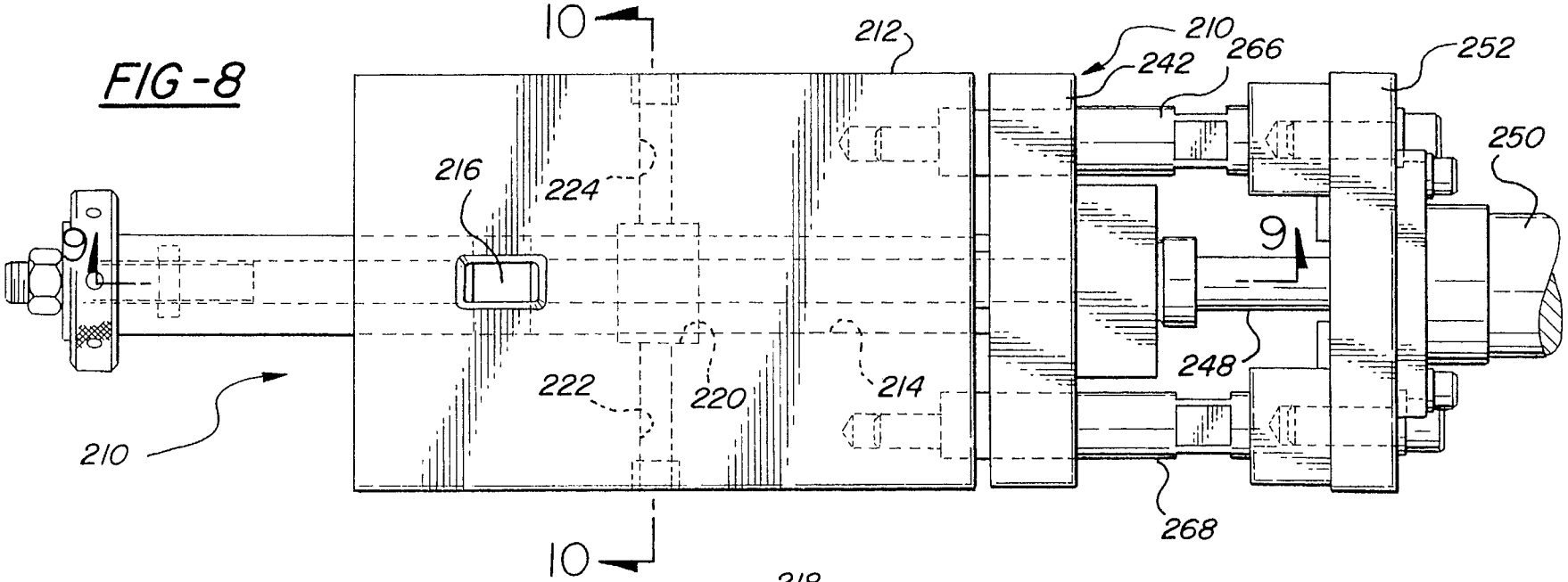
FIG. 8 is a plan view of a third embodiment of bulk lubricant delivery unit in accordance with the invention.
Figure 9:
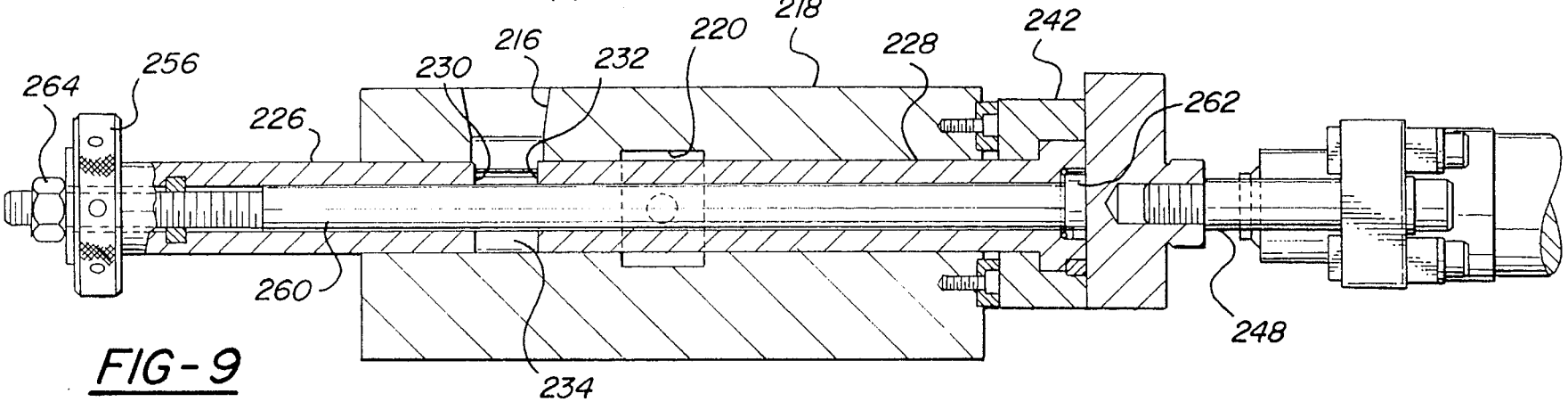
FIGS. 9 and 10 are side and transverse cross-sectional views from the planes of lines 9—9 and 10—10 of FIG. 8.
Figure 10:
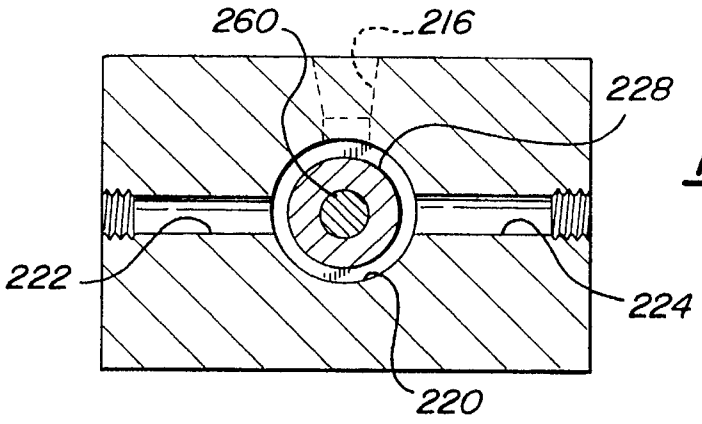

FIGS. 8–10 of the drawings illustrate a third embodiment of bulk lubricant delivery unit in accordance with the invention and generally indicated by numeral 210. As before, since many of the elements are similar, series 200 numbers with corresponding suffix numbers are used to describe similar parts.

Delivery unit 210 includes a body 212 having a through bore 214 and a rectangular inlet 216 opening through the top 218 of the body. A relief 220 surrounds the bore at the discharge position as previously described. In the body, a gas inlet passage 222 and a gas/lubricant delivery passage 224 connect with the relief 220 and extend through opposite sides of the body 212. In this embodiment, the form of the slide differs in that the plungers 226, 228 are of tubular form and include annular ends 230, 232, respectively, which again lie in opposed spaced relation and define an annular chamber 234.

The former adjusting and transfer heads and guide rods are dispensed with and instead an adjusting rod 260 is provided that extends through the hollow centers of the plungers 226, 228 and connects through head 262 with the outer end of plunger 228. At its other end, rod 260 is threaded to engage a nut 264 and lock ring 256. These permit longitudinal adjustment of the plunger 226 relative to plunger 228 and locking of the plungers in the adjusted position. The adjustment varies the volume of the loading chamber 234 as before to adjust the amount of lubricant charge which is received and delivered during each cycle.

A cylinder 250 is mounted on a straddle mount 252 which is connected by support rods 266, 268 to the body 212. A transfer head 242 longitudinally connects the plunger 228 and adjusting rod 260 with the cylinder rod 248 for longitudinal motion of the slide plungers 226, 228 with the cylinder rod 248.

Operation of this third embodiment is functionally similar to that of the embodiments previously described except that the loading and discharge chamber 234 is annular in form because its center is occupied by the adjusting rod 260. Nevertheless, loading of lubricant into chamber 234 and transfer of the slide from the loading position to the discharge position by motion of the cylinder rod 248 is followed by discharge of the lubricant by air delivery through passage 222 picking up lubricant in the annular chamber and discharging it with the air through passage 224 in essentially the same manner as in the previously described embodiments.

Figure 11:
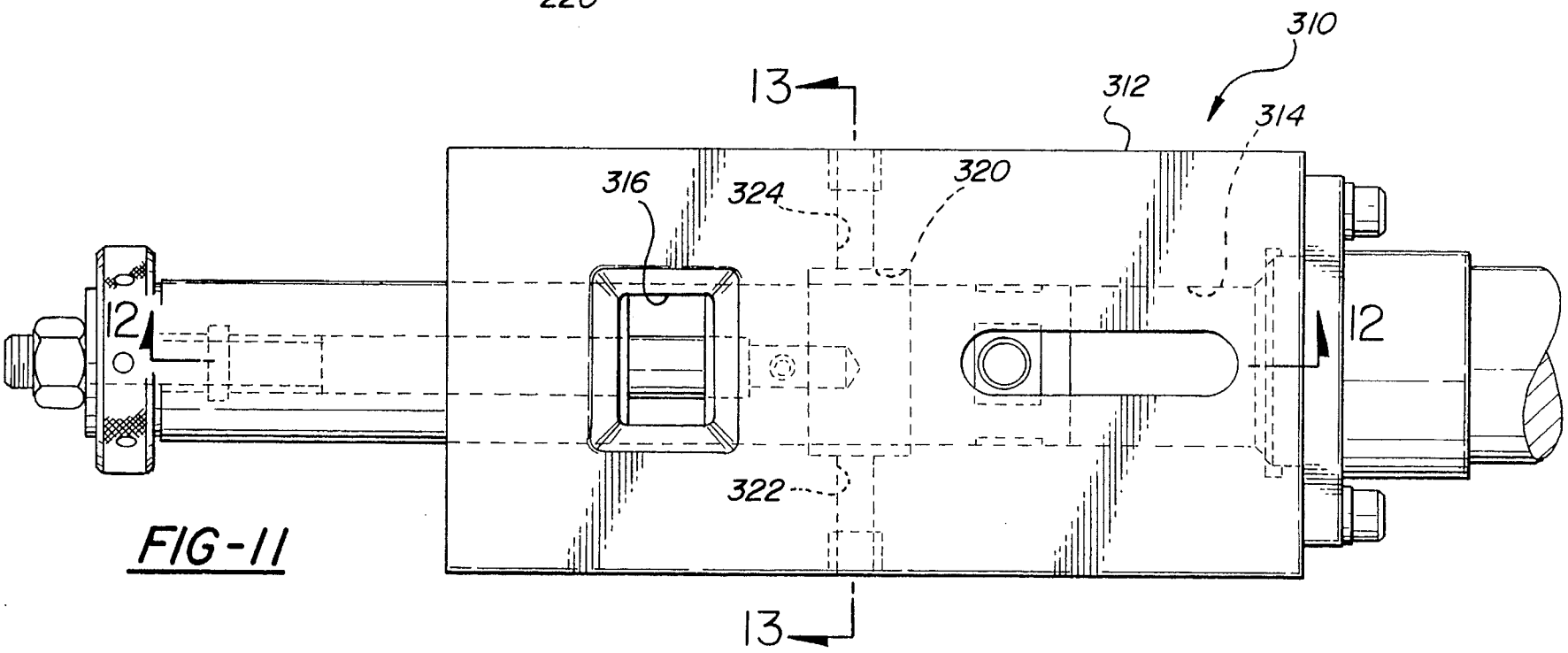
FIG. 11 is a plan view of a fourth embodiment of bulk lubricant delivery unit in accordance with the invention.
Figure 12:
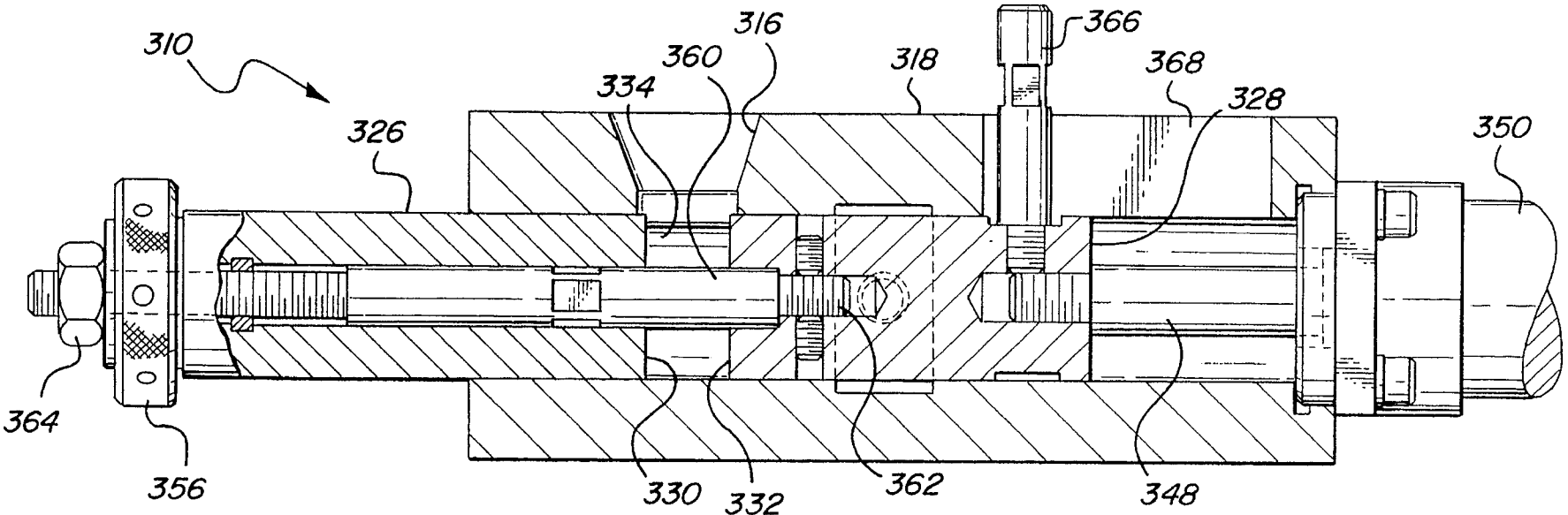
FIGS. 12 and 13 are side and transverse cross-sectional views from the planes of lines 12—12 and 13—13 of FIG. 11.
Figure 13:
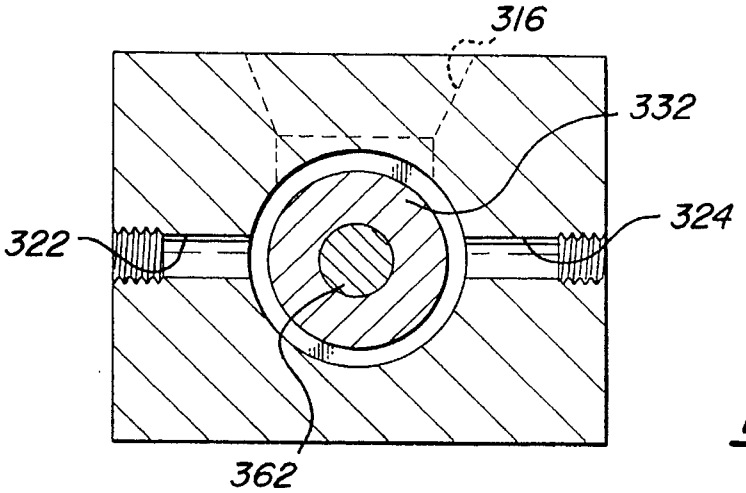

FIGS. 11–13 illustrate a fourth embodiment of bulk lubricant delivery unit according to the invention and generally indicated by numeral 310. Unit 310 also includes a body 312 having a through bore 314 intersected by a rectangular inlet 316 opening through the top 318 of the body. A relief 320 is provided around the bore at the delivery position and is connected with a gas inlet passage 322 and a delivery passage 324 extending through opposite sides of the body.

A transfer slide is in this case made up of a tubular plunger 326 and a solid plunger 328 having opposed annular ends 330, 332, respectively. These, in part, define an annular chamber 334 similar to that of the previously described embodiment. The plungers 326, 328 are connected by an adjusting rod 360 which has a threaded end 362 engaging a bore in plunger 328. An opposite threaded end is engaged by a nut 364 and a lock ring 356 to provide longitudinal adjustment of the tubular plunger 326 relative to the solid plunger 328. A cylinder 350 is mounted directly on one end of the body 312 and has a rod 348 that is directly connected with an outer end of the solid plunger 238. A stud 366 extends laterally from a seat in the solid plunger 228 through a slot 368 in the body to the exterior for indicating the position of the plunger and actuating a limit switch if desired.

Operation of the delivery unit 310 is essentially the same as that of the previously described unit 210 although the construction is simplified by elimination of the straddle mount and other details.

FIGS. 14–17 illustrates a fifth embodiment of bulk lubricant delivery unit according to the invention and generally indicated by numeral 410. Unit 410 is the first of three embodiments to be illustrated which while similar in some ways to those previously described differ significantly in the form of the transfer slide and charge adjusting mechanisms.

Delivery unit 410 includes a body 412 defining a through bore 414 as before. The bore is intersected by an inlet 416 which in this case is circular in cross section and tapers slightly upwardly to an opening through the top 418 of the body 412. At a location spaced longitudinally from the inlet 416, the bore 414 is also intersected by a gas inlet passage 422 and a gas/lubricant delivery passage 424 opening through opposite sides of the body and connecting with opposite sides of the bore.

In the present embodiment, the transfer slide involves only a single cylindrical plunger 426 reciprocable within the bore 414. Between its ends, the plunger includes a loading chamber 434 best shown in FIG. 16. Chamber 434 includes a cylindrical opening 460 extending from the top of the plunger 426 down to a transversely slotted or milled portion 462 extending across about the lower third of the plunger 426. The plunger is also provided with a discharge chamber 464 best shown in FIG. 17. Chamber 464 is spaced longitudinally from the loading chamber 434 and located in communication with passages 422, 424, when the loading chamber 434 is aligned with the inlet 416 as shown in the drawings. Chamber 464 is defined essentially by cutout portions 466, 468, 470 located on opposite sides and along the bottom of the plunger 426. These cutout portions form a U-shaped chamber which connects on one side with the gas inlet passage 422 and on the opposite side with the gas/lubricant delivery passage 424. These passages 422, 424 define the discharge position of the body.

Fixed to the bottom of the body 412 is a charge control unit 472 having a support 474 carrying a cylindrical plunger 476 that extends into a cylindrical opening 478 in the body 412 that intersects the bore 414 below the delivery position. Plunger 476 has an arcuate upper end 480 which is shaped to approximately match the curvature of the bore 414 and is positionable from a position closely below the bore to a lower position spaced a desired distance below the bore. Plunger 476 is prevented from turning in the opening 478 by a key 482 which engages a flat 484 provided on the side of the plunger. Any suitable means may be used for adjusting the vertical position of the plunger 476, two differing embodiments of which will be discussed in conjunction with subsequently described embodiments of the invention.

The transfer slide plunger 426 is reciprocable in bore 414 between the loading and delivery position illustrated and a transfer position wherein the loading chamber 434 is moved longitudinally into the delivery position. There it communicates with the portion of the cylindrical opening 478 which is above the arcuate upper end 480 of the charge control plunger 476. This movement of the transfer slide plunger 426 is, as before, driven by a cylinder 450 which is mounted on a straddle mount 452 secured by support posts 486, 488 to the body 412. A cylinder rod 448, driven by the cylinder, connects through a transfer head 490 with the plunger 426 to provide the necessary longitudinal motion of the plunger between the two positions.

Figure 14:
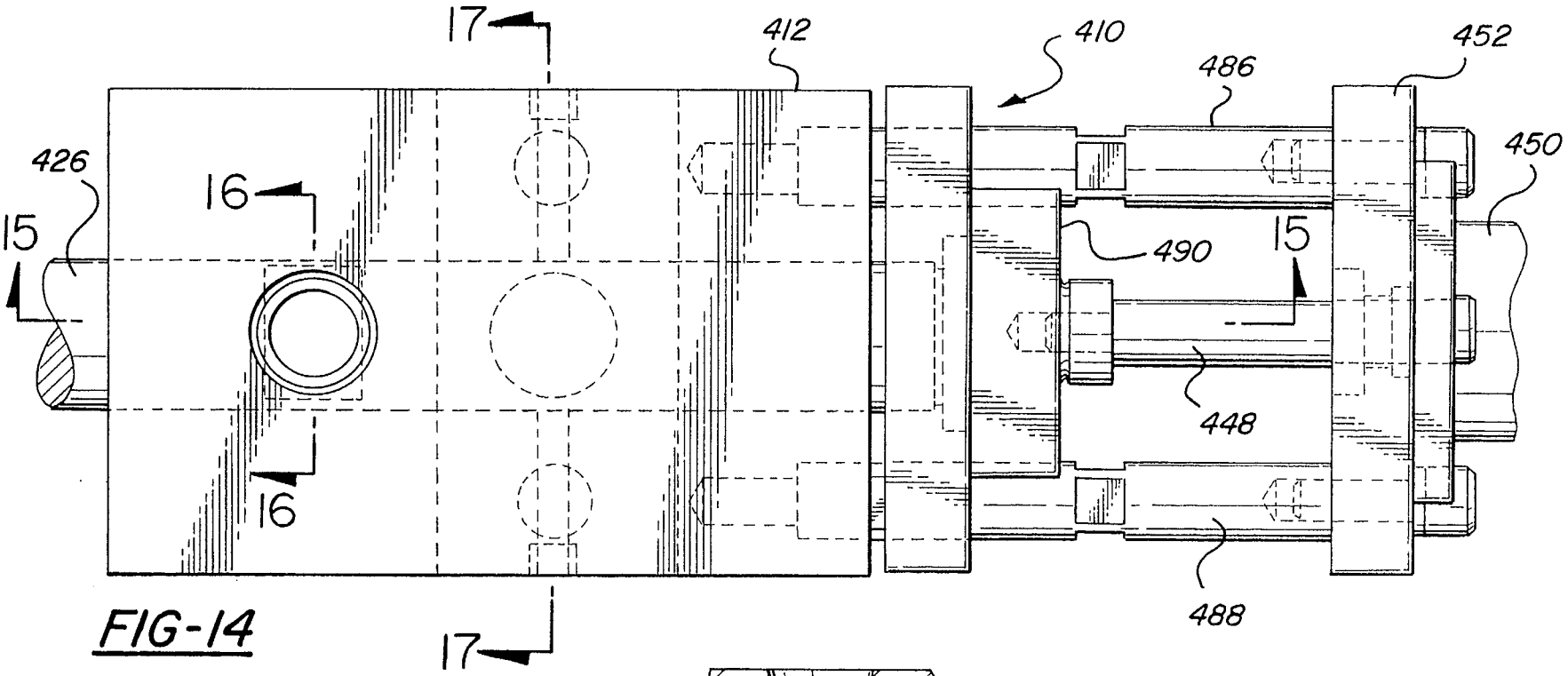
FIG. 14 is a plan view of a fifth embodiment of bulk lubricant delivery unit according to the invention beginning a second group of three related embodiments.
Figure 16:
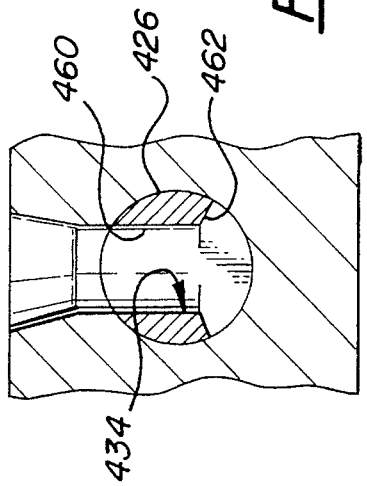
FIGS. 15, 16, and 17 are side and separate transverse cross-sectional views from the planes of lines 15—15, 16—16, and 17—17 of FIG. 15, respectively.
Figure 15:
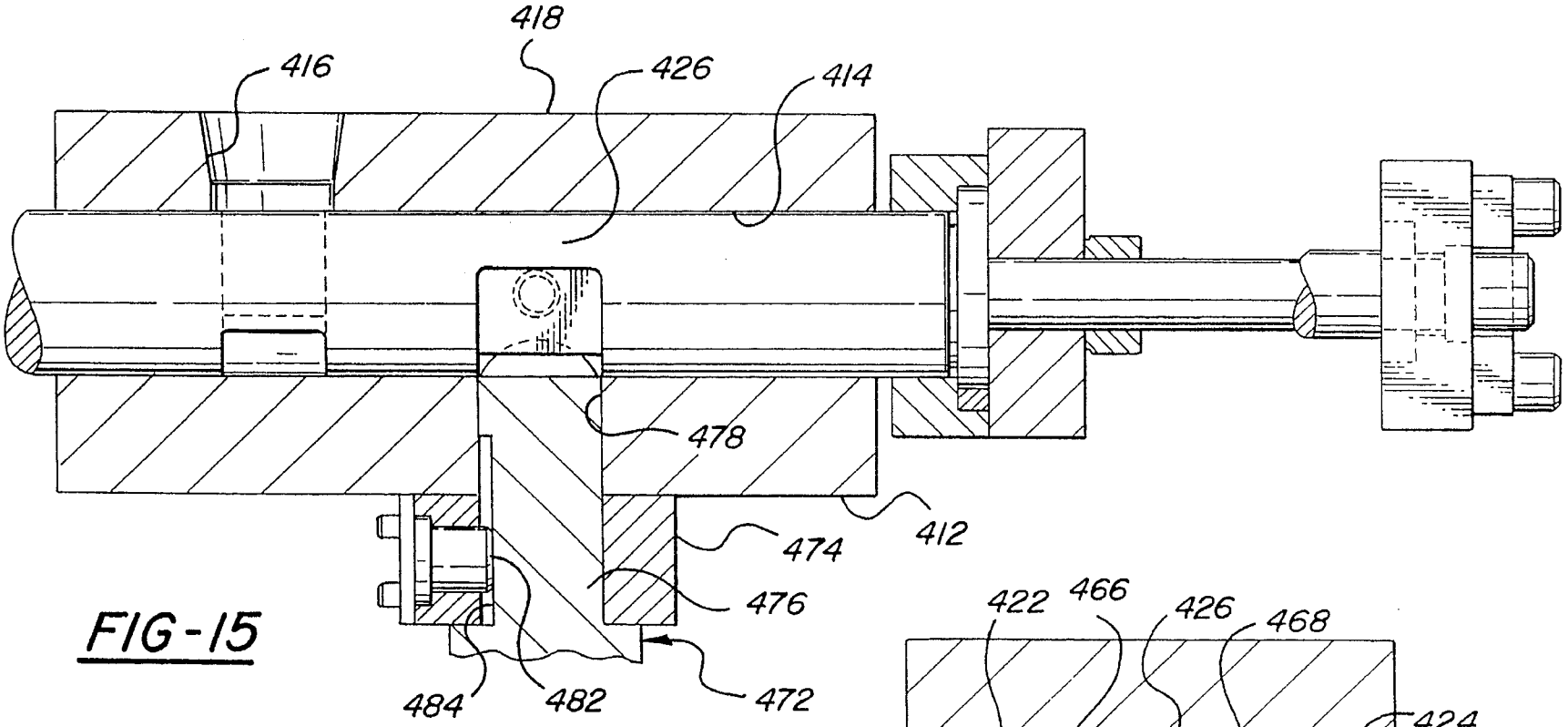
Figure 17:
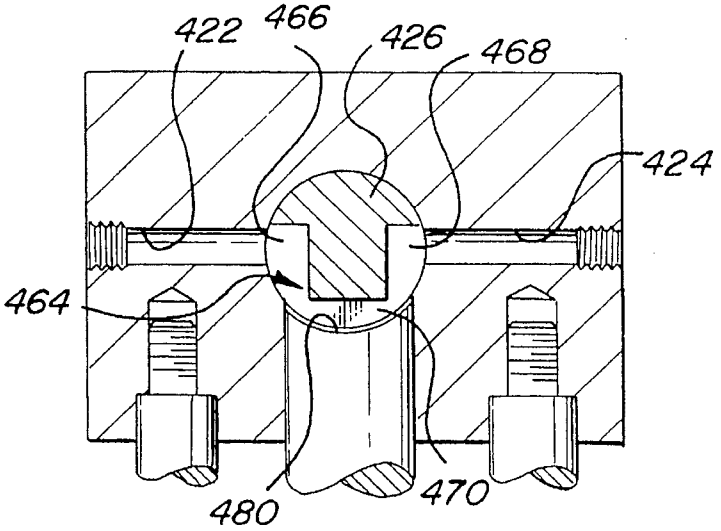

In operation, lubricant which may be dry, or liquid if suitable seals are provided, is delivered from a suitable container, not shown, through the inlet 416 to the loading chamber 434, filling this chamber. The transfer slide 426 is then moved to the right, as shown in FIGS. 14 and 15 of the drawings, by the cylinder 450, until the loading chamber reaches the discharge position where all or part of the charge drops into opening 478 to a depth determined by the position of the charge control plunger 476. The transfer slide plunger 426 is then returned to its original position by actuation of cylinder 450 carrying with it any portion of the original charge which has not fallen into opening 478 below the outer diameter of the transfer bore 414. The remaining charge in the delivery position is then located below the U-shaped delivery chamber in the portion of the charge control bore 478 extending to the upper end 480 of the charge control plunger 476.

At the proper time, this charge of lubricant is delivered to a connecting mechanism by compressed air fed through inlet passage 422 and directed downwardly against the lubricant charge by the U-shape of the delivery chamber. The lubricant is thus swept up by the passing air flow and out through delivery passage 424 in a lubricant air mixture which is carried to the associated mechanism. At the same time, the loading chamber 434 in the transfer slide has returned to the loading position and receives a fresh charge of lubricant through the inlet 416, ready for another cycle.

Figure 18:
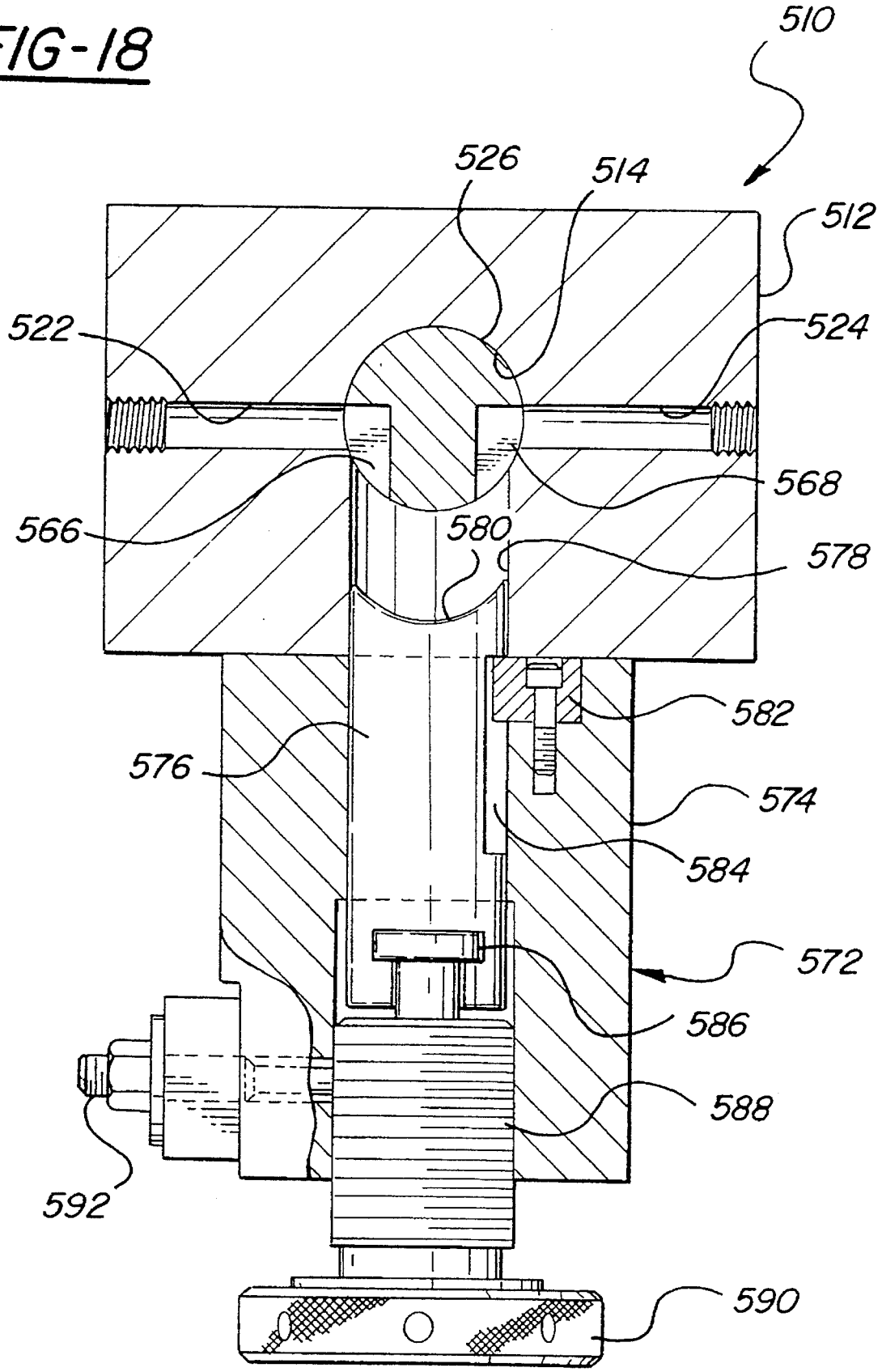
FIG. 18 is a cross-sectional view similar to FIG. 17 but showing features of a sixth embodiment of bulk lubricant delivery unit according to the invention.

FIG. 18 illustrates pertinent portions of a sixth embodiment of bulk lubricant delivery unit in accordance with the invention and generally indicated by numeral 510. Unit 510, to the extent it is not illustrated, may be considered identical with the unit 410 previously described. Unit 510 thus includes a body 512 having a bore 514 extending longitudinally therethrough to which are connected, in a discharge position, a gas inlet passage 522 and a lubricant/gas discharge passage 524. A transfer slide plunger 526 includes a pair of cutouts 566, 568 for directing air from passage 522 downward to a discharge chamber defined in part by a charge control unit 572. The lower cutout 470 of the previous embodiment is omitted to assure that the air passes through the charge in the chamber. The charge control unit includes a support block 574 which carries a charge control plunger 576 as before. Plunger 576 extends into a cylindrical opening 578 in the body 512 and has an arcuate upper end 580 which is adjustably spaced below the bore 514. A key 582 mounted in the block 574 engages a slot 584 of the plunger 576 to prevent it from turning.

The plunger 526 is connected by a slotted end with a head 586 formed on the end of a threaded adjusting screw 588. A knurled adjusting wheel 590 permits rotation of the screw to move the charge control plunger 576 vertically toward and away from the bore 514. A threaded locking screw and nut assembly 592 is mounted on the support 574 for locking the adjusting screw 588 in its adjusted position. Operation of the unit 510 is as described with respect to unit 410, the fifth embodiment described previously.

Figure 19:
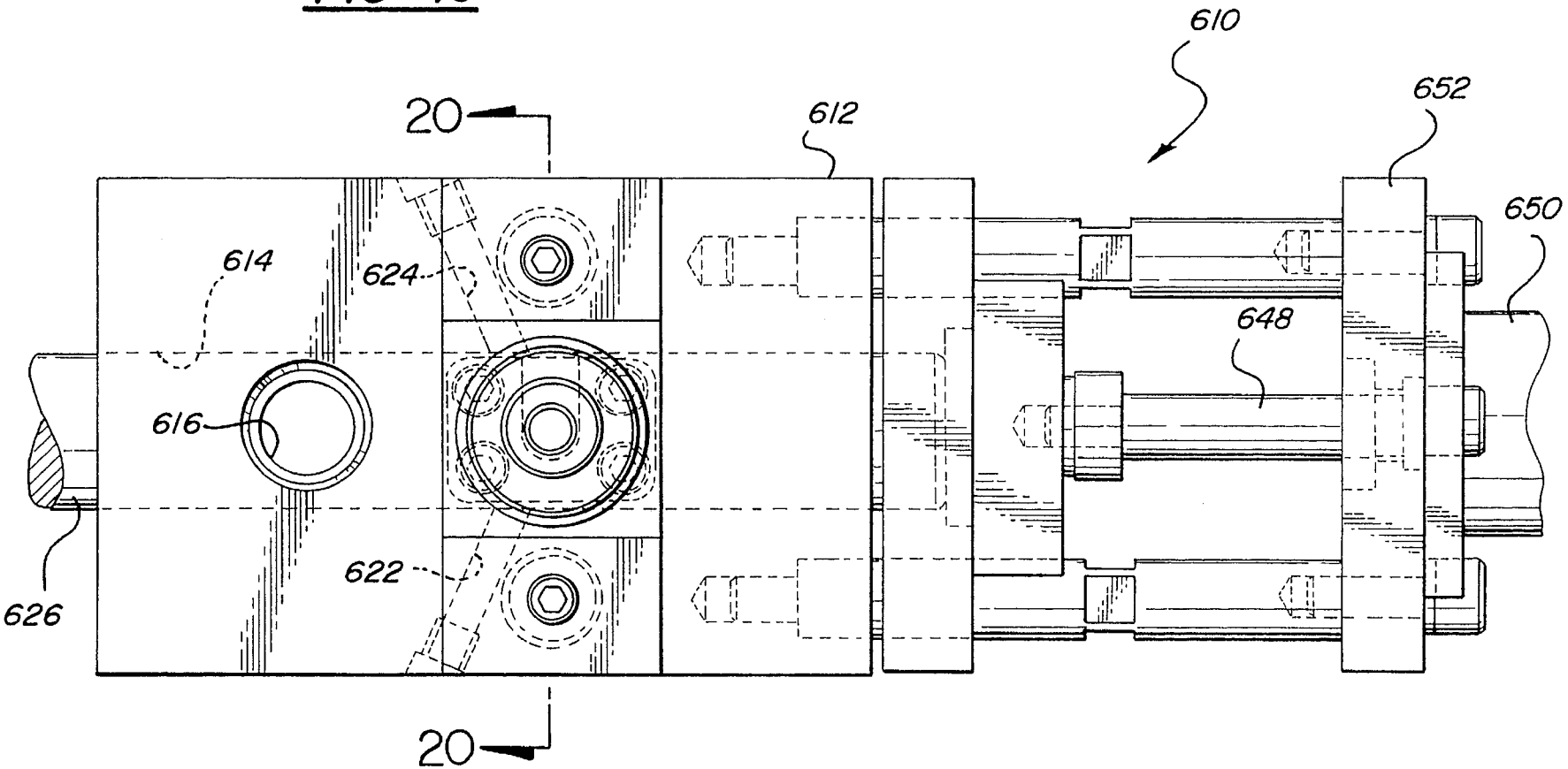
FIG. 19 is a plan view of a seventh embodiment of bulk lubricant delivery unit according to the invention.
Figure 20:
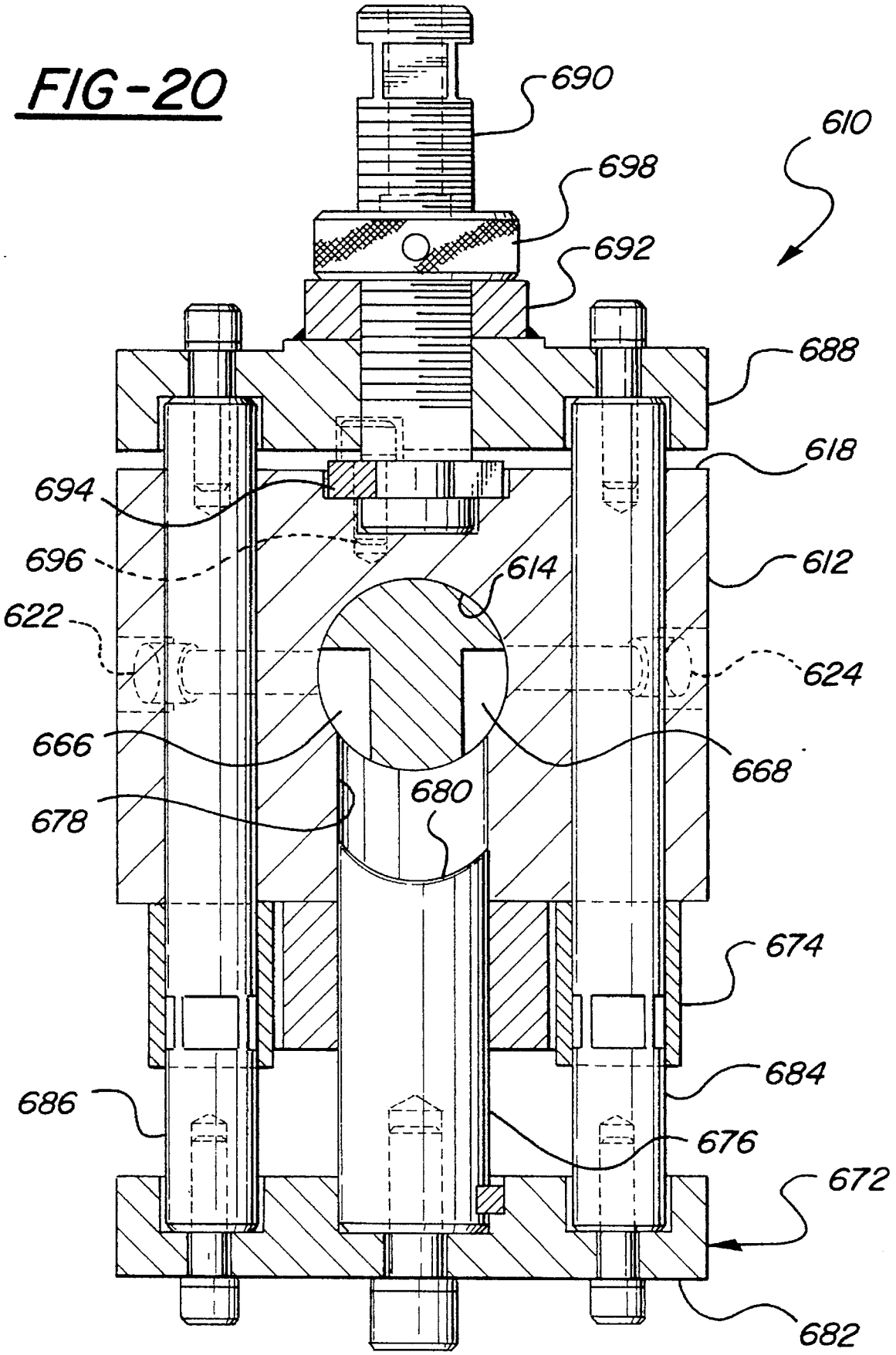
FIG. 20 is a transverse cross-sectional view from the plane of line 20—20 of FIG. 19.

FIGS. 19 and 20 illustrate a seventh embodiment of bulk lubricant delivery unit formed according to the invention and indicated by numeral 610. Unit 610 is basically similar to the previously described fifth and sixth embodiments of delivery units 410 and 510. Thus units 610 includes a body 612 having a through bore 614 with a circular inlet 616 intersecting the bore at a loading position and opening through the top 618 of the body. A gas inlet passage 622 and a gas/lubricant delivery passage 624 intersect the bore 614 at a delivery position and these are angled longitudinally for a purpose to be described subsequently. A transfer slide plunger 626 extends through the bore 614 and includes a loading chamber, not shown, similar to that of unit 410 and a discharge chamber partially defined by cutouts 666 and 668 as in unit 510.

The actuating cylinder 650 is mounted on a straddle mount 652 and drives a cylinder rod 648 which connects with plunger 626 and drives it in the manner described for unit 410.

Unit 610 also includes a charge control unit 672 including a support 674 and charge control plunger 676 extending into an opening 678 of the body 612. The upper end 680 of the plunger 676 is arcuately shaped to match the bore 614, all as previously described with respect to unit 410. The unit differs, however, in that the plunger 676 is attached to a transfer head 682 and keyed thereto to prevent its rotation. The head 682 connects with guide rods 684, 686 which extend through bores in the support 674 and block 612 and are attached at their opposite ends to an adjusting head 688. Adjusting head 688 is movable toward and away from the body 612 by a screw 690 which engages a threaded nut 692 attached to the head 688. Screw 690 includes a collar 694 rotatable in a recess of the body and retained therein by a retaining screw 696. A lock ring 698 may be tightened to lock the screw 690 in its adjusted position.

Movement of the adjusting head 688 vertically also moves the transfer head 682 and thereby the plunger 676 which adjusts the volume of the delivery chamber located above the upper end 680 of the plunger. Operation of the unit is otherwise as described with respect to unit 410. As is apparent, the angling of the passages 622, 624 longitudinally forward is provided to make clearance for the guide rods 684, 686 which are located laterally beside the delivery chamber.

Figure 21:
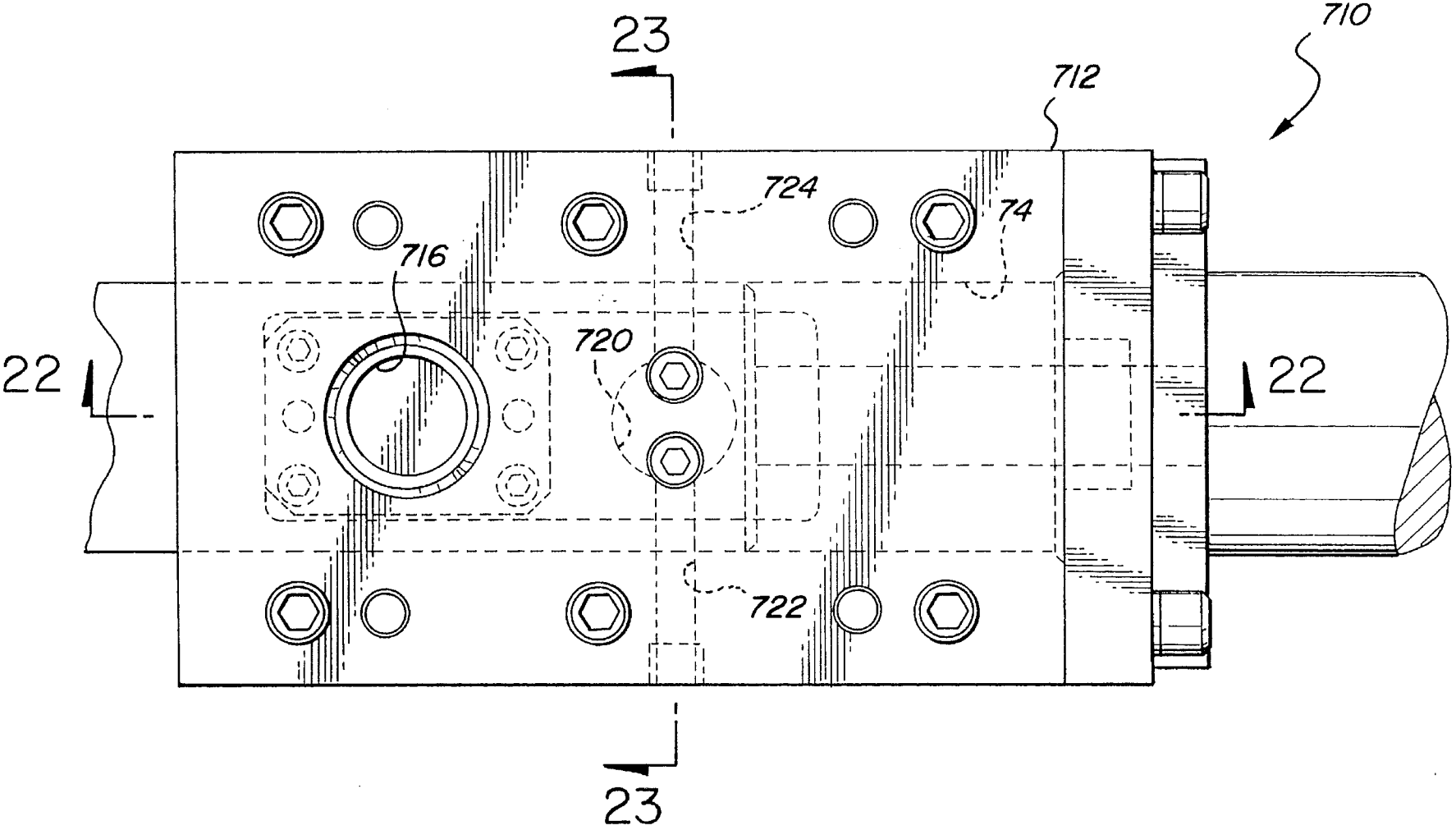
FIG. 21 is a plan view of an eighth embodiment of bulk lubricant delivery unit according to the invention beginning a third group of two related embodiments.
Figure 23:
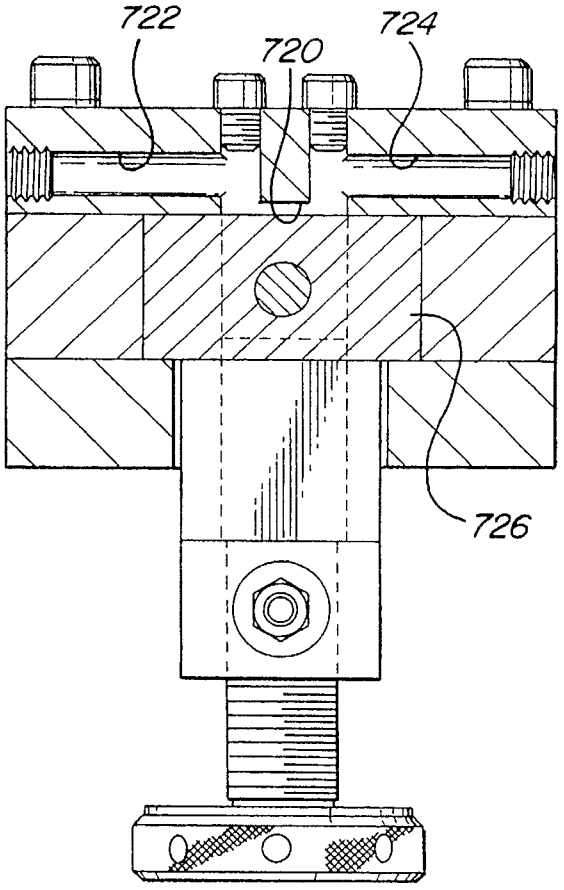
FIGS. 22 and 23 are longitudinal and transverse cross-sectional views from the planes of lines 22—22 and 23—23 of FIG. 21.
Figure 22:
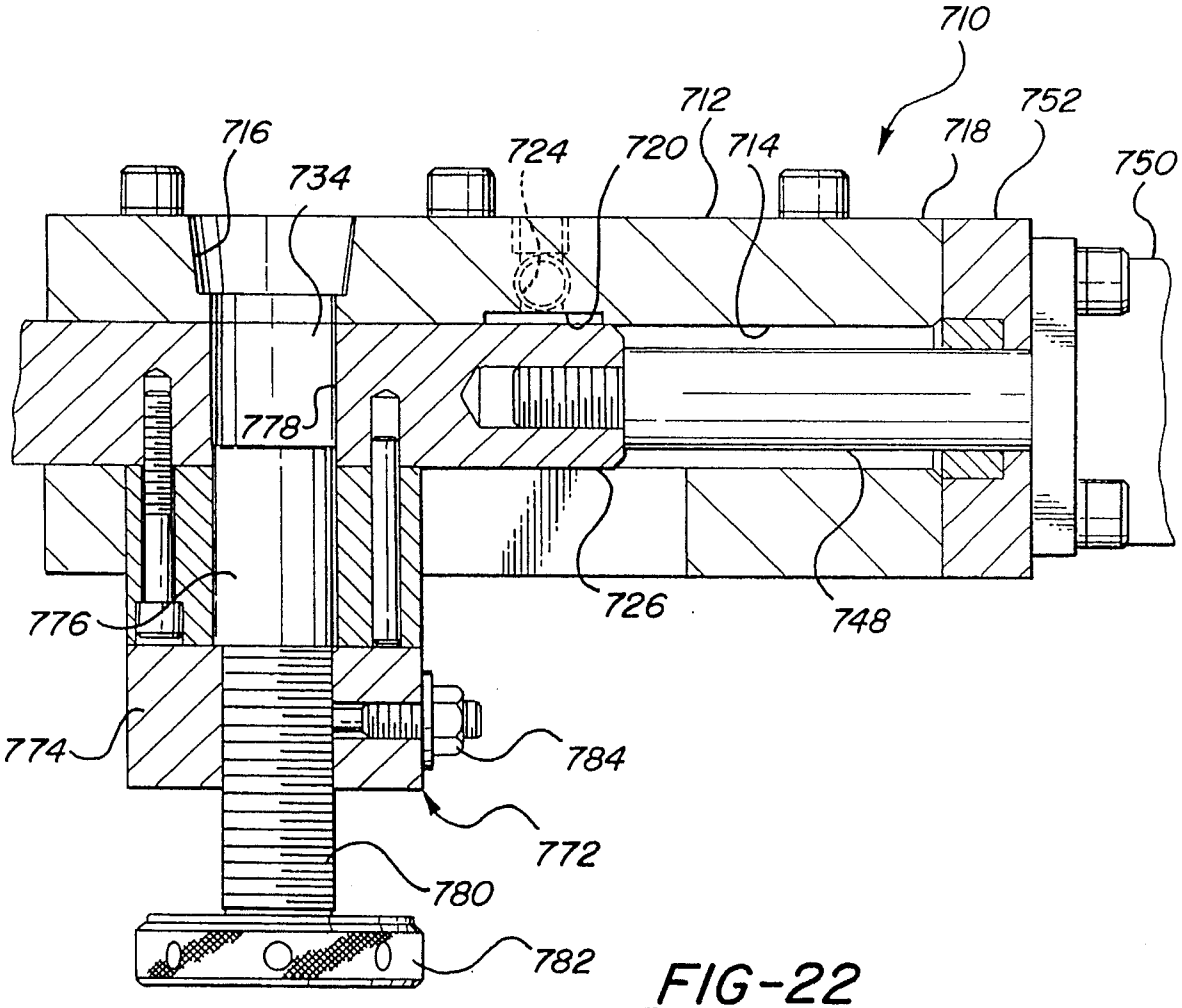

FIGS. 21–23 illustrate an eighth embodiment of bulk lubricant delivery unit according to the invention and indicated by numeral 710. Unit 710 represents the first of two units which differ significantly from the previous units described and yet have some similar characteristics.

Thus unit 710 includes a rectangular body 712 which is assembled of multiple elements, not numbered, to define a longitudinally extending rectangular opening 714. A circular inlet 716 extends through the top 718 of the body to the longitudinal opening 714 at a loading position of the unit. Similarly, a gas inlet passage 722 and a gas/lubricant delivery passage 724 connect from opposite sides of the body 712 to opposite sides of a recess 720 formed centrally of the body above the longitudinal opening 714 at a discharge position of the unit. A rectangular transfer slide 726 is reciprocably movable within the opening 714 and is actuated by a cylinder rod 748 of a cylinder 750 mounted on a closed end 752 of the body 712.

Attached to and movable with the transfer slide 726 is a charge control unit 772. Unit 772 includes a support 774 which is fixed to and movable with the slide 726 and carries a charge control plunger 776 extending into a bore 778 extending vertically through the transfer slide 726. The bore 778 and the charge control plunger 776 together define a variable volume loading chamber 734. The volume of the chamber is varied by movement of the plunger by means of an adjusting screw 780 connected thereto and actuated by an adjusting wheel 782. A lock screw and nut assembly 784 is provided to lock the plunger in its adjusted position.

In operation, with the transfer slide 726 in the loading position shown in the figures, dry or other suitable lubricant is fed from a container, not shown, through the inlet 716 to the loading chamber 734. Actuation of cylinder 750 shifts the transfer slide 726 to the right in FIGS. 21 and 22 until the loading chamber 734 is aligned with the recess 720 in the delivery position. The charge control unit 772, of course, moves with the slide to the new position, maintaining the selected volume of charge in the loading chamber 734. At this point, delivery of compressed air flow through inlet passage 722 picks up lubricant in the chamber 734 and blows it out with the air flow through the delivery passage 724 and to a connected mechanism.

Figure 24:
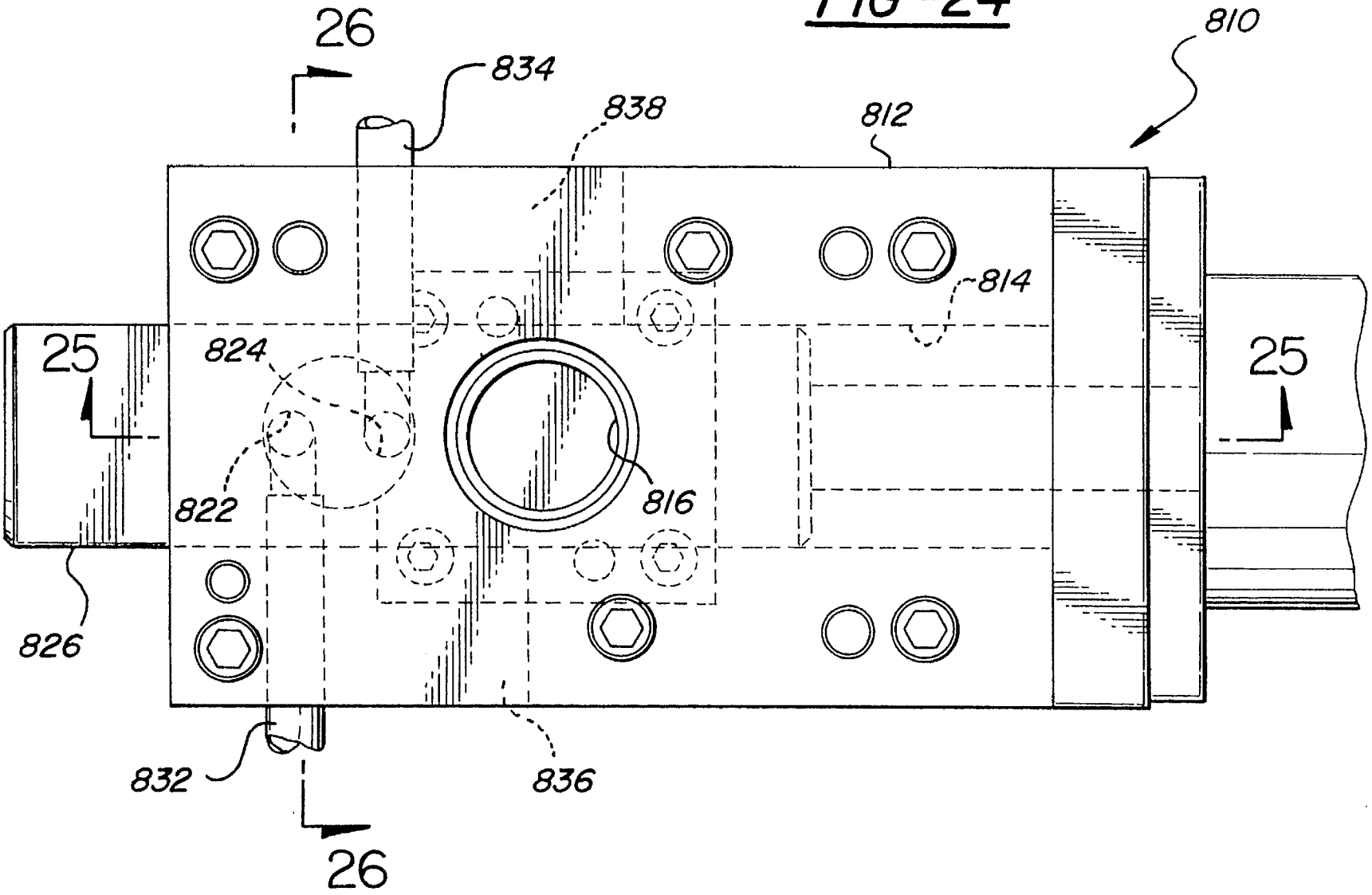
FIG. 24 is a plan view of a ninth embodiment of bulk lubricant delivery unit according to the invention.
Figure 26:
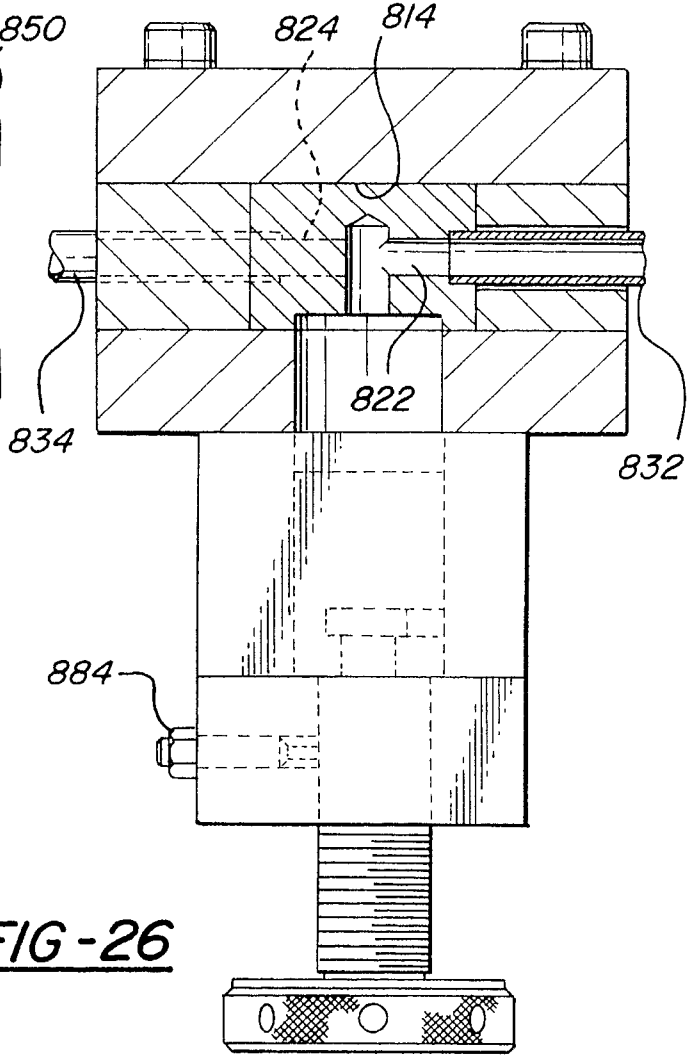
FIGS. 25 and 26 are longitudinal and transverse cross-sectional views from the planes of lines 25—25 and 26—26 of FIG. 24.
Figure 25:
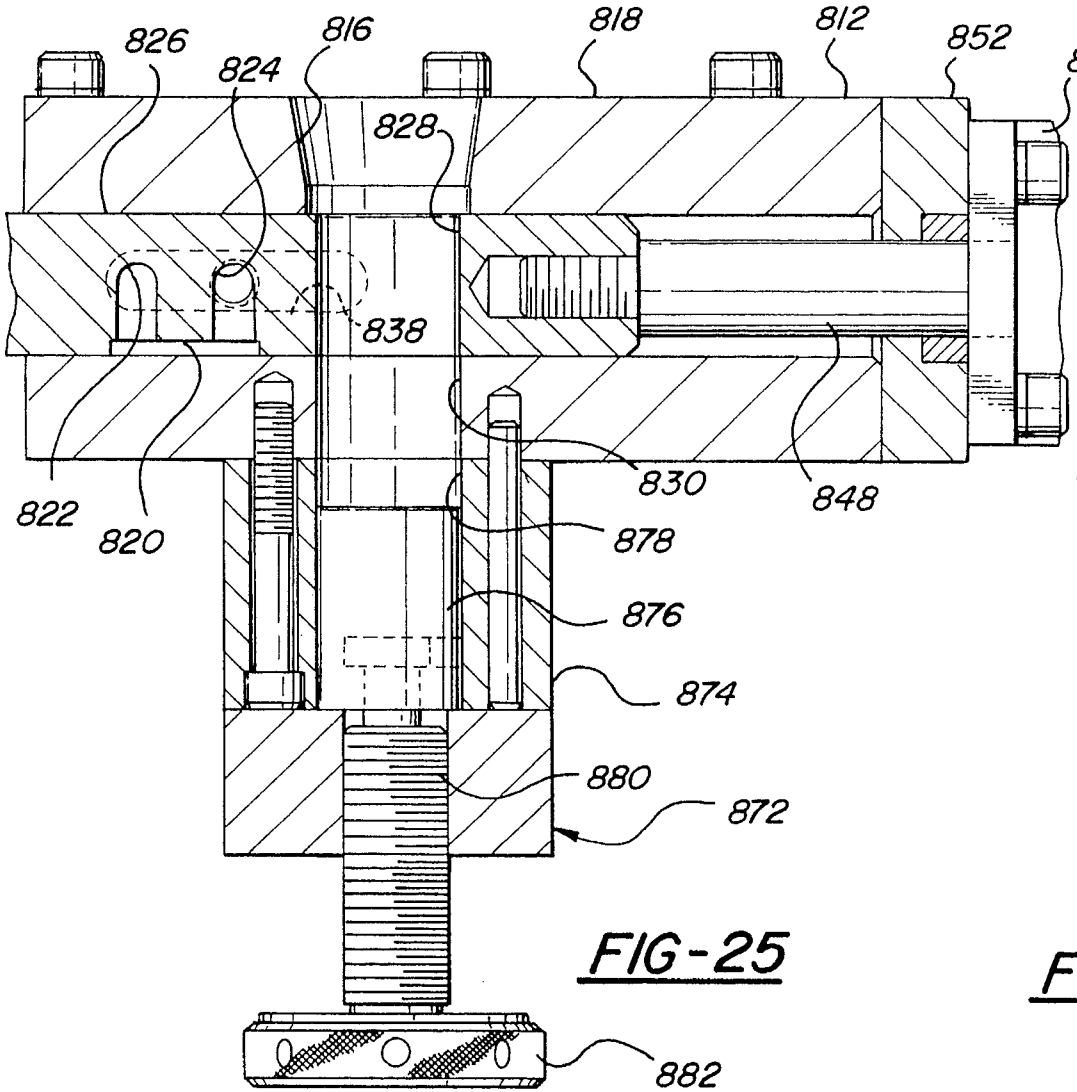

FIGS. 24–26 illustrate a ninth embodiment of bulk lubricant delivery unit according to the invention and generally indicated by numeral 810. As before, unit 810 includes a rectangular body 812 having a longitudinally extending rectangular opening 814 extending therein. The body also includes a circular inlet 816 extending from the opening 814 through the top 818 of the body. A rectangular transfer slide 826 is reciprocable within the opening 814 and includes a vertical passage 828 which, in the loading position shown in the figures, is aligned with the inlet 816 and with a cylindrical opening 830 in the bottom portion of the body 812. A charge control unit 872 similar to that described with respect to unit 710, but mounted on the bottom of the body 812, is located below the opening 830. Charge control unit 872 includes a support 874 carrying a reciprocable plunger 876 within a bore 878 and vertically adjustable by an adjusting screw 880 driven by an adjusting wheel 882. A lock screw and nut assembly 884 is used to lock the adjusting screw 880 in position.

Longitudinally spaced from the path of slide passage 828 is a circular recess 820 formed in the bottom of the slide 826 and connecting with a gas inlet passage 822 and a gas/lubricant delivery passage 824. These passages extend out through connecting tubes 832, 834, respectively, which are movable with the slide 826 in slots 836, 838, respectively, provided in the sides of the body 812. The transfer slide 826 is connected with a cylinder rod 848 of a cylinder 850 which is mounted on a closed end 852 of the body 812.

In the loading position shown, lubricant from a container, not shown, is delivered, such as by gravity, through the circular inlet 816 and passage 828 to the opening 830 and bore 878. Plunger 876 is adjustable within bore 878 and up into the cylindrical opening 830, if desired, to vary the volume of the loading chamber which, in this instance, extends below the bottom of the transfer slide 826. When the loading chamber is filled, actuation of the cylinder 850 draws the transfer slide 826 to the right as shown in FIGS. 24 and 25 until the recess 820 of the slide is located over the opening 830. At this point, compressed air may be delivered through the inlet passage 822 and is forced into the opening 830 below the recess 820 where it picks up the lubricant and blows it out through the discharge passage 824 with the flow of compressed air, delivering it to an associated mechanism in the same manner as with the previously described embodiments.

While the delivery units described have included transfer slides longitudinally movable by direct connection with an actuating cylinder, any other suitable means for moving the slides could also be used. For example, a rack and pinion drive could be used where rack teeth are provided on the slide, or an extension thereof, and a pinion drives the teeth. The pinion could be rotated by any means, including, for example, a cylinder actuated lever.

Figure 27:
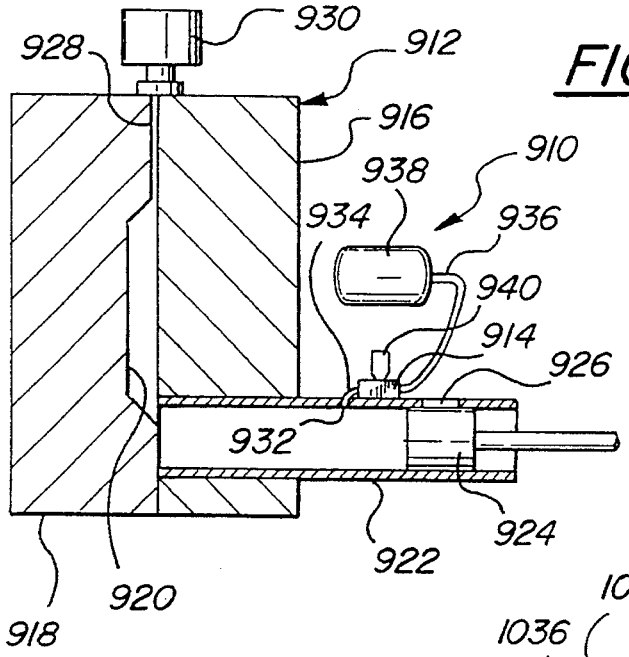
FIGS. 27 and 28 are semi-schematic side cross-sectional views illustrating two different embodiments of die casting apparatus connecting a bulk lubricant delivery unit according to the invention with a conventional aluminum die casting machine.

FIG. 27 illustrates a first embodiment of die casting apparatus according to the invention and generally indicated by numeral 910. Apparatus 910 includes an essentially conventional aluminum die casting machine 912 connected with a bulk lubricant delivery unit 914 according to the invention.

The die casting machine 912 includes a conventional die pair including a stationary (ejector) die 916 and a movable (cover) die 918 which together define an internal cavity 920. In operation, the cavity 920 is filled with molten aluminum from a shot sleeve 922 containing a plunger 924 which is moved leftward in the sleeve 922 to force the metal from the sleeve into the connecting cavity 920. A pour hole 926 is provided in the shot sleeve 922 for allowing molten aluminum to be poured into the sleeve when the plunger 924 is fully retracted. A vent passage 928 connects an upper portion of cavity 920 with an externally mounted vacuum valve 930 connected with an external source of vacuum not shown. The vacuum valve may be of any suitable type such as, for example, that shown in my prior U.S. Pat. No. 5,101,882 issued Apr. 7, 1992.

The die casting machine 912 is of generally conventional construction except that it is modified by provision of a lubricant fill opening 932 in the shot sleeve inward of the pour hole 926. Opening 932 is connected by suitable tubing or hose 934 with the delivery passage, not shown, of the lubricant delivery unit 914. The gas inlet passage, not shown, of the delivery unit is in turn connected through a tubing or a hose 936 with a compressed air tank 938 or other source of compressed air. A gravity feed lubricant container 940 is mounted on top of the delivery unit 14 for supplying lubricant to the unit.

In operation, the shot plunger 924 is advanced to block the pour hole 926 and then a vacuum is drawn through the vacuum valve 930 to evacuate the die cavity 920 and the connecting shot sleeve 922. The lubricant delivery unit 914 is then actuated by forcing air through the unit to pick up and deliver a mixture of air and lubricant through opening 932 into the shot sleeve. The mixture is delivered with such force that the lubricant is atomized and sprayed into the shot sleeve from which it also passes into the die cavity 920 where it is drawn by the vacuum in the total system. The lubricant thereby coats the die cavity and the interior of the shot sleeve.

At the conclusion of lubricant delivery, the plunger 924 is retracted and molten metal is poured into the pour hole 926, after which the plunger is forced quickly forward to force the molten metal into the die cavity in known manner to form an aluminum casting. A vacuum may again be applied to the cavity through the vacuum valve 930 and vent passage 928 to draw off any gases formed in the die casting process and allow the aluminum to completely fill the cavity. When the metal is hardened, the movable die 918 is moved away from the fixed die 916 by the machine mechanism not shown. The cast part including runners and other remnants of aluminum from the die casting process are removed from the die. At this point, air pressure may also be forced from the tank 938 through the delivery unit 914 and fill opening 932 to clean out any aluminum particles which may have entered the fill opening and connected hose 934. The process may then be repeated by again returning the plunger 924 to a position blocking the pour hole 926.

Figure 28:
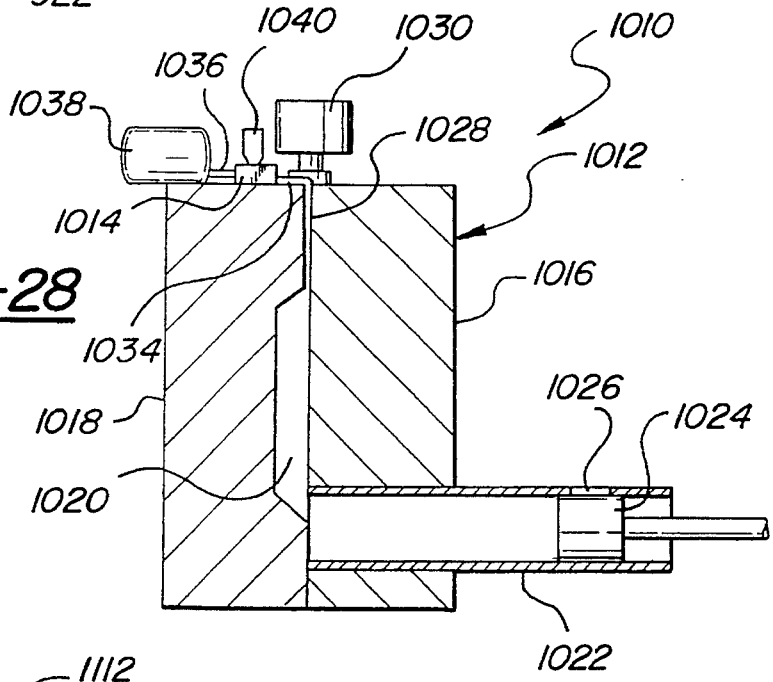

FIG. 28 illustrates a second embodiment of die casting apparatus according to the invention and generally indicated by numeral 1010. Apparatus 1010 includes nearly all the same elements as in apparatus 910 so that similar components are indicated by 1000 series numbers with like suffix numerals. Thus apparatus 1010 includes a die casting machine 1012 mounted with a lubricant delivery unit 1014 located, in this case, on top of the stationary die 1016. The apparatus 1010 further includes a movable die 1018 defining cavity 1020 and a shot sleeve 1022 with a plunger 1024 closing the pour hole 1026. A vent passage 1028 connects the cavity 1020 with a vacuum valve 1030 and also, through a hose 1034 with the delivery unit 1014. Unit 1014 is, in turn, connected with a compressed air tank 1038 and has a lubricant container 1040 mounted thereon.

Operation of unit 1010 is the same as that of the unit previously described except that lubricant from the delivery unit 1014 is delivered through the vent passage 1028 to the die cavity 1020 and shot sleeve 1022 after a vacuum has been drawn within these spaces while the plunger covers the pour hole 1026 as shown.

Figure 29:
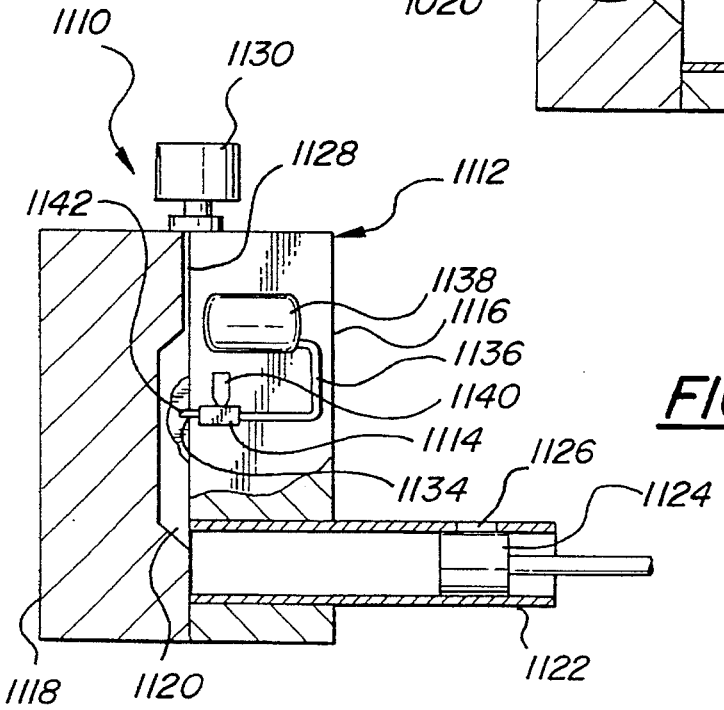
FIG. 29 is a side view partially in section similar to FIGS. 27 and 28 but showing a third embodiment of die casting apparatus.

FIG. 29 illustrates a third embodiment of die casting apparatus generally indicated by numeral 1110. Apparatus 1110 includes essentially the same elements as apparatus 1010 including the die casting machine 1112, delivery unit 1114, stationary die 1116, movable die 1118 defining cavity 1120, shot sleeve 1122 with plunger 1124 and pour hole 1126, and a vent passage 1128 connecting with vacuum valve 1130. In this case, the delivery unit 1114 is mounted on the side of the stationary die 1116, connects with a compressed air tank 1138 and includes a lubricant container 1140 mounted on the unit 1114. The delivery opening, not shown, of unit 1114 connects by a hose 1134 with a fill passage 1142 extending inwardly along the split line between the movable and stationary dies 1118, 1116, respectively.

Operation of apparatus 1110 is the same as with those previously described, except that the air/lubricant mixture is sprayed into the die cavity and shot sleeve from below while the vacuum is drawn on these cavities as before. Optionally, the delivery unit could be connected with a passage at any other point of the die split line leading between the die pair from the exterior to the cavity 1120 and the delivery unit 1114 could be appropriately located.

Figure 30:
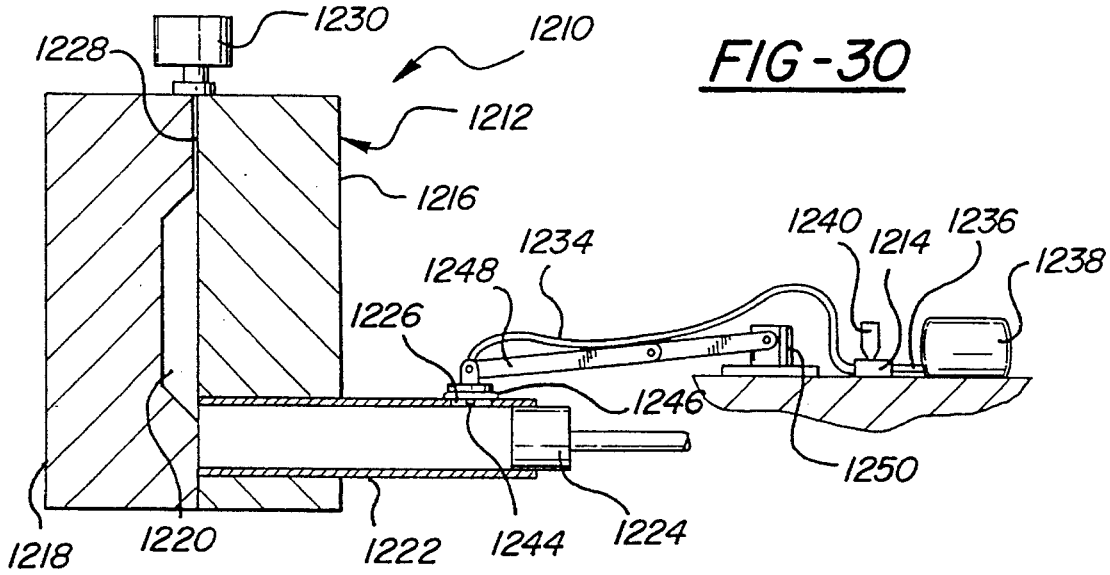
FIGS. 30 and 31 are cross-sectional views of a fourth embodiment of die casting die casting apparatus showing two positions of a movable lubricant feeding nozzle.

FIG. 30 illustrates a fourth embodiment of die casting apparatus according to the invention and generally indicated by numeral 1210. Apparatus 1210 includes a conventional die casting machine 1212 including a stationary die 1216, movable die 1218 forming cavity 1220, and a shot sleeve 1222 with plunger 1224 and pour hole 1226, as well as a vent passage 1228 connecting with the vacuum valve 1230. In this case, the bulk lubricant delivery unit 1214 is separately mounted and is provided with a lubricant container 1240 and connected with a compressed air tank 1238. Unit 1214 is also connected through a fill hose 1234 with a nozzle 1244 shown extending through the pour hole 1226 into the shot sleeve 1222. Nozzle 1244 is surrounded by a stopper 1246 that closes the pour hole while the nozzle is in place therein. Nozzle 1244 is supported by a movable arm 1248 of a robot 1250 separately mounted adjacent the die casting machine 1212.

In the position shown in FIG. 30, the robot arm has positioned the nozzle 1244 within the pour hole 1226 which is closed by the stopper 1246 so that a vacuum may be drawn within the shot sleeve 1222 and connecting cavity 1220 in the usual manner. An air/lubricant mixture is then delivered by the delivery unit 1214 with air from the compressed air tank 1238 forcing the atomized lubricant into the evacuated shot sleeve and adjacent cavity 1220.

Figure 31:
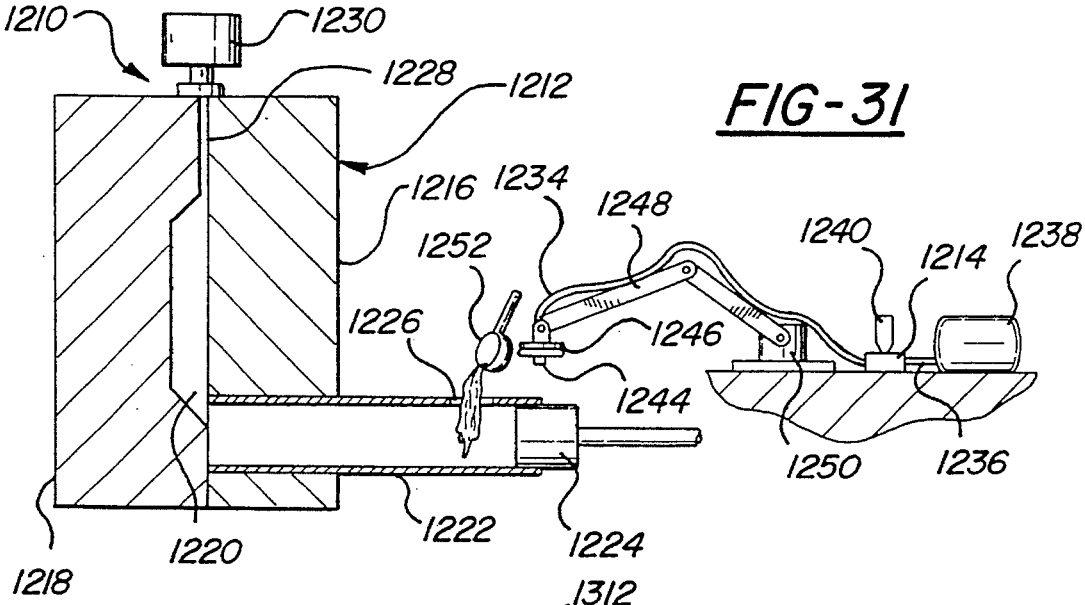

FIG. 31 illustrates the same embodiment illustrated in FIG. 30 but in a subsequent mode of operation wherein the robot arm 1248 has raised and removed the nozzle 1244 from the pour hole 1226, allowing a ladle 1252 to pour molten aluminum through the pour hole 1226 into the shot sleeve for compression and delivery into the die cavity 1220 in the manner previously described. If desired, this embodiment could be operated to close the pour hole 1226 with the stopper 1246 after the metal is poured. A vacuum could then be drawn on the cavity 1220 prior to moving of the plunger 1224 inward to force the metal into the die cavity 1220.

Figure 32:
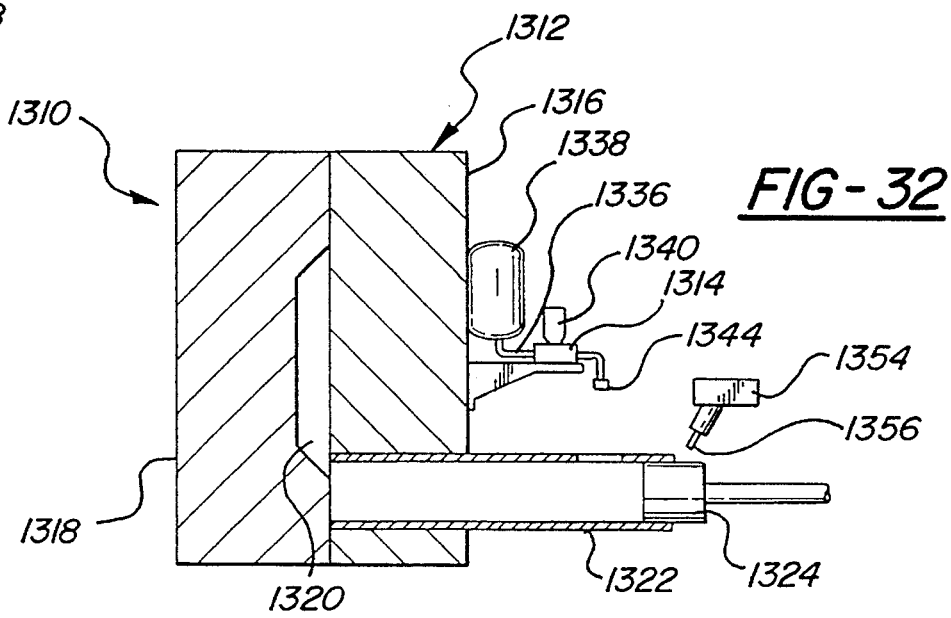
FIG. 32 is a cross-sectional view showing an alternative embodiment for lubricating only the shot sleeve and/or the plunger of a die casting apparatus.

FIG. 32 illustrates a fifth embodiment of die apparatus according to the invention and generally indicated by numeral 1310. Apparatus 1310 includes a conventional die casting machine 1312 including a stationary die 1316, movable die 1318 forming cavity 1320, and a shot sleeve 1322 with plunger 1324 and pour hole 1326, as well as a vent passage 1328. A vacuum valve is omitted as is common with many die casting machines. A bulk delivery unit 1314 with lubricant container 1340 and connected with a compressed air tank 1338 is mounted adjacent the shot sleeve 1322. Unit 1314 connects through delivery hose 1334 with a nozzle 1344 above the pour hole 1326 to spray lubricant into the sleeve at a desired time in the cycle between the die casting operations.

A second lubricator 1354 with nozzle 1356 may also be provided for delivering liquid or dry lubricant directly to the plunger 1324 when it is in the retracted position shown. Lubricator 1354 may be like delivery unit 1314 with its connected equipment or it could be of another type if desired. Obviously, also, the embodiment could be varied by eliminating one or the other nozzle and delivery unit if desired.

While the invention has been described by reference to various specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A bulk lubricant delivery unit for delivery of bulk lubricant to a die casting die apparatus, said unit characterized by:

a body having an inlet for receiving a charge of bulk lubricant from a supply source;

a transfer member within said body and movable between loading and delivery positions, said transfer member including two aligned plungers having opposed ends;

a delivery chamber defined between said body and said transfer member in said delivery position;

said transfer member having a transfer space between said plunger ends and communicating with said inlet in said loading position, said transfer space forming a part of said delivery chamber when said transfer member is moved into said delivery position; and a charge control for varying the volume of lubricant charge transferred from said transfer space in said loading position to said delivery chamber in said delivery position, said charge control including a charge control mechanism interconnecting said plungers for adjusting the distance between said plunger ends to vary the volume of said transfer space and said delivery chamber.

2. A lubricant delivery unit as in claim 1 characterized in that said charge control mechanism includes a transfer head and an adjusting head connected one to each plunger, guide rods interconnecting said heads and a longitudinal adjuster between said adjusting head and its connected plunger.

3. A lubricant delivery unit as in claim 2 characterized in that said adjuster includes a threaded connection between said adjusting head and its connected plunger and a threaded lock for locking said connection in an adjusted position.

4. A lubricant delivery unit as in claim 1 characterized in that said plungers are cylindrical and are movable within a cylindrical bore of said body.

5. A lubricant delivery unit as in claim 1 characterized in that said inlet is a generally rectangular opening.

6. A lubricant delivery unit as in claim 2 characterized by seals between said body and said plungers to prevent the leakage of lubricant from said transfer space and said delivery chamber.

7. A lubricant delivery unit as in claim 1 characterized in that said plungers are actuated by a cylinder.

8. A lubricant delivery unit as in claim 7 characterized in that said cylinder is connected with said body and has an actuating rod connected with said plungers.

9. A lubricant delivery unit as in claim 7 characterized in that said cylinder is connected with said plungers and has an actuating rod connected with said body.

10. A lubricant delivery unit as in claim 1 characterized in that at least one of said plungers is tubular and said charge control mechanism includes an adjusting rod extending through said tubular plunger and connecting with the other of said plungers.

11. A lubricant delivery unit as in claim 10 characterized in that said tubular plunger connects with said adjusting rod through an adjuster.

12. A lubricant delivery unit as in claim 10 characterized in that both of said plungers are tubular and said adjusting rod extends through both plungers.

13. A lubricant delivery unit as in claim 1 characterized in that said supply source is a bulk lubricant container connected with said inlet.

14. A lubricant delivery unit as in claim 1 characterized in that said delivery chamber includes a gas inlet and a gas/lubricant mixture outlet for the atomization and delivery of bulk lubricant in a high velocity gas carrier from the delivery chamber to an associated die apparatus.

15. A lubricant delivery unit as in claim 1 characterized in that said transfer member comprises a linear slide driven by a power actuator between said loading and delivery positions.

16. A lubricant delivery unit as in claim 7 characterized in that said actuator is a direct acting cylinder.

* * * * *